US011808448B2

(12) United States Patent
Caloca et al.

(10) Patent No.: US 11,808,448 B2
(45) Date of Patent: Nov. 7, 2023

(54) BURNER ASSEMBLIES FOR A COOKTOP

(71) Applicant: WHIRLPOOL CORPORATION, Benton Harbor, MI (US)

(72) Inventors: Victor Gerardo Caloca, Guanajuato (MX); Victor H. Manrique, St. Joseph, MI (US); Alok C. Deshpande, Maharashtra (IN); Tiziano Lacchè, Matelica (IT); Eshita Pal, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 415 days.

(21) Appl. No.: 17/102,816

(22) Filed: Nov. 24, 2020

(65) Prior Publication Data

US 2022/0163199 A1 May 26, 2022

(51) Int. Cl.
*F23D 14/06* (2006.01)
*F24C 3/08* (2006.01)

(52) U.S. Cl.
CPC ..... *F23D 14/06* (2013.01); *F24C 3/082* (2013.01); *F23D 2203/101* (2013.01); *F23D 2900/14062* (2013.01)

(58) Field of Classification Search
CPC ..... F23D 14/06; F23D 2203/101; F24C 3/082
USPC ..... 126/39 E, 39 R
See application file for complete search history.

(56) References Cited

U.S. PATENT DOCUMENTS

| | | | | |
|---|---|---|---|---|
| 6,537,065 | B1 | 3/2003 | Shirali et al. | |
| 6,851,420 | B2 | 2/2005 | Jennings | |
| 9,844,300 | B2 | 12/2017 | Cedar et al. | |
| 10,578,302 | B2 | 3/2020 | Santinanavat et al. | |
| 2013/0269676 | A1* | 10/2013 | Quintaba' | F23D 14/08 126/39 E |
| 2014/0318528 | A1* | 10/2014 | Quintaba1 | F23D 14/08 126/39 E |
| 2015/0040887 | A1* | 2/2015 | Angulo | F24C 3/08 126/39 E |
| 2016/0327277 | A1* | 11/2016 | Emiliani | F23D 14/26 |
| 2019/0107287 | A1* | 4/2019 | Kitabayashi | F24C 3/085 |
| 2019/0242583 | A1 | 8/2019 | Paller | |

FOREIGN PATENT DOCUMENTS

| | | | |
|---|---|---|---|
| CN | 202361372 | U | 8/2012 |
| CN | 105605575 | A | 5/2016 |
| CN | 206890516 | U | 1/2018 |
| CN | 109404911 | A | 3/2019 |
| DE | 19805559 | A1 | 8/1999 |
| DE | 102016119530 | A1 | 4/2018 |
| EP | 3268667 | A1 | 1/2018 |
| EP | 3604918 | A1 | 2/2020 |
| JP | 6405592 | B2 | 9/2018 |

(Continued)

*Primary Examiner* — Vivek K Shirsat
(74) *Attorney, Agent, or Firm* — Price Heneveld LLP

(57) ABSTRACT

A burner assembly for a cooktop comprises a spreader comprising (i) a central portion through which an axis extends, the central portion with a bottom surface, (ii) a plurality of apertures through the spreader, the plurality of apertures disposed further away from the axis than the central portion, and (iii) a ridge projecting from the bottom surface, the ridge disposed further from the axis than the central portion but closer to the axis than the plurality of apertures.

21 Claims, 31 Drawing Sheets

(56) References Cited

FOREIGN PATENT DOCUMENTS

| | | | |
|---|---|---|---|
| KR | 20040076701 | | 9/2004 |
| KR | 20120103302 | A | 9/2012 |
| WO | 2016142872 | A1 | 9/2016 |

* cited by examiner

BURNER ASSEMBLIES FOR A COOKTOP

BACKGROUND OF THE DISCLOSURE

The present disclosure generally relates to burner assemblies for a cooking appliance such as a cooktop, and more specifically, to burner assemblies that reduce flame lift and flame flashback.

A kitchen appliance sometimes performs a cooking function. Sometimes the kitchen appliance performs the cooking function at a surface that is open to an external environment, such as when the kitchen appliance is a cooktop or a range with a cooktop. The cooktop can utilize one of several methods to produce heat that performs the cooking function. Those methods include combustion of a mixture of air and gaseous fuel, electrical resistance, and induction. When the cooktop relies upon combustion of the mixture of air and gaseous fuel, a burner assembly can be utilized to deliver the mixture of air and gaseous fuel.

However, several problems can arise. First, with some burner assemblies, where the mixture of air and gaseous fuel is converted into a flame at gas outlets, a velocity of the mixture of air and gaseous fuel to the ports exceeds the speed at which the mixture of air and gaseous fuel can combust into the flame, which results in the flame lifting from the burner. This is sometimes referred to as "flame lift." Second, with some burner assemblies, the flame propagates back upstream into the burner assembly. This is an effect sometimes referred to as "flashback," and the result can be an audible popping noise.

SUMMARY OF THE DISCLOSURE

The present disclosure addresses the flame lifting problem with a spreader for a burner assembly that spreads the mixture of air and gaseous fuel outward toward a plurality of apertures and includes a downward extending ridge that interferes with the flow of the mixture of air and gaseous fuel to the plurality of apertures. The ridge reduces a velocity of the mixture of air and gaseous fuel before the mixture of air and gaseous fuel reaches the plurality of apertures to flow out of the burner assembly and become combusted into the flame. Therefore, the velocity of the mixture of air and gaseous fuel exiting the plurality of apertures does not exceed the speed at which the mixture of air and gaseous fuel combusts into the flame. Thus, the flame does not lift from the burner assembly.

In addition, the present disclosure addresses the flashback problem with a perforated sheet (such as a perforated metal sheet) that is disposed in fluid communication before a spreader with a plurality of apertures. The mixture of air and gaseous fuel flows through the perforated sheet (that is, through a plurality of apertures through the perforated sheet), and then through the plurality of apertures of the spreader to become combusted into the flame. Should the flame proceed back upstream through the plurality of apertures of the spreader, the perforated sheet quenches the flame. That prevents flashback further into the burner assembly and prevents the generation of noise that further flashback would have caused. The perforated sheet further reduces the velocity of the mixture of air and gaseous fuel before combustion and, thus, also reduces the likelihood of flame lifting.

According to one aspect of the present disclosure, a burner assembly for a cooktop comprises: a spreader comprising (i) a central portion through which an axis extends, the central portion with a bottom surface, (ii) a plurality of apertures through the spreader, the plurality of apertures disposed further away from the axis than the central portion, and (iii) a ridge projecting from the bottom surface, the ridge disposed further from the axis than the central portion but closer to the axis than the plurality of apertures.

In embodiments, the ridge forms a contiguous perimeter around the bottom surface of the central portion. In embodiments, the ridge comprises an inner surface closest to the axis that forms an angle relative to the bottom surface of the central portion that is greater than 90 degrees and less than 120 degrees. In embodiments, the spreader further comprises (i) an outer portion disposed further away from the axis than the plurality of apertures and the ridge, and (ii) a plurality of spaced fingers, each separated by one of the plurality of apertures, bridging the central portion to the outer portion. In embodiments, the spreader comprises a top surface, and the top surface at the central portion is elevated higher than the top surface at the outer portion.

In embodiments, the burner assembly further comprises: a burner cap disposed over the spreader, the burner cap comprising (i) a central portion disposed over the central portion of the spreader, with the axis of the spreader extending through the central portion of the burner cap, (ii) an outer portion disposed further away from the axis than the central portion of the burner cap, the outer portion of the burner cap disposed over the outer portion of the spreader, (iii) a middle portion disposed further away from the axis than the central portion of the burner cap but closer to the axis than the outer portion of the burner cap, the middle portion disposed above the plurality of apertures of the spreader, and (iv) a plurality of apertures through the middle portion. The outer portion of the burner cap assembly comprises a flange that surrounds a lateral edge of the spreader.

In embodiments, the burner assembly further comprises: a venturi comprising (i) an internal surface defining a passageway for a mixture of air and gaseous fuel, (ii) an inlet into the passageway in communication with a source of air and a source of gaseous fuel and (iii) an outlet out of the passageway in fluid communication with the plurality of apertures of the spreader. The axis extends through the central portion of the spreader and also extends into the outlet of the venturi. In embodiments, the ridge of the spreader comprises an inner surface that (i) forms an approximately right angle relative to the bottom surface of the central portion and (ii) is at least approximately parallel to the axis, the inner surface disposed at a radius from the axis. The internal surface that defines the passageway at the outlet has a radius from the axis. The radius of the internal surface defining the passageway at the outlet is less than the radius of the inner surface of the ridge of the spreader. The mixture of air and gaseous fuel flows (i) through the passageway of the venturi toward the outlet of the venturi, (ii) out the outlet of the venturi, (iii) and through the plurality of apertures of the spreader. The ridge of the spreader reduces a velocity of the mixture of air and gaseous fuel before the mixture of air and gaseous fuel flows through the plurality of apertures of the spreader. In embodiments, a base is disposed between the spreader and the venturi, and the base comprises (i) a central aperture through which the axis that extends through the central portion of the spreader also extends, the central aperture in fluid communication with the passageway of the venturi, and (ii) an annular ridge at the top around and defining the central aperture, the annular ridge of the base disposed closer to the axis than the ridge projecting from the bottom surface of the spreader.

In embodiments, the burner assembly further comprises: a mixture of air and gaseous fuel flowing (i) through the passageway of the venturi toward the outlet of the venturi, (ii) out the outlet of the venturi, (iii) through the central aperture of the base, (iv) between the annular ridge of the top of the base and the ridge projecting from the bottom surface of the spreader, and (v) through the plurality of apertures of the spreader. The ridge that projects from the bottom surface of the spreader reduces a velocity of the mixture of air and gaseous fuel before the mixture of air and gaseous fuel flows through the plurality of apertures of the spreader.

In embodiments, the base further comprises an inner surface that defines the central aperture, the inner surface being parallel to the axis and having a radius from the axis. The internal surface that defines the passageway at the outlet has a radius from the axis. The radius of the internal surface defining the passageway at the outlet is approximately equal to the radius of the inner surface defining the central aperture of the base.

In embodiments, the base further comprises a second annular ridge at the top of the base that surrounds the annular ridge and, with the annular ridge, defines an annular recess that is planar and perpendicular to the axis. The spreader further comprises a second ridge at a bottom of the spreader that is further away from the axis than the ridge of the spreader, the second ridge disposed over the top of the base and facing the second annular ridge of the base, with the second ridge of the spreader being closer to the axis than the second annular ridge of the base.

According to another aspect of the present disclosure, a burner assembly for a cooktop comprises: (a) a base comprising (i) a tubular wall defining a passageway through which an axis extends, the tubular wall having a first end defining an inlet into the passageway and a second end defining an outlet of the passageway, (ii) a lateral wall extending laterally outward from the tubular wall, and (iii) an outer wall extending upward from the lateral wall and forming a perimeter around the lateral wall, the outer wall is more elevated from the bottom wall than the second end of the tubular wall; (b) a spreader disposed above the tubular wall and the lateral wall of the base, the spreader comprising (i) a central portion through which the axis extends, the central portion disposed above the outlet of the passageway of the base, (ii) an outer portion surrounding the central portion, the outer portion terminating in an edge that defines a lateral perimeter of the spreader away from the axis, with the outer wall of the base surrounding the edge of the outer portion of the spreader, and (iii) a plurality of apertures through the spreader at the outer portion; and (c) a perforated sheet disposed between the base and the spreader, the perforated sheet comprising (i) a central portion through which the axis extends, the central portion disposed between the central portion of the spreader and the tubular wall of the base, (ii) an outer portion further away from the axis than the central portion, the outer portion disposed between the lateral wall of the base and the outer portion of the spreader, the outer portion terminating in an edge, with the outer wall of the base surrounding the edge of the outer portion of the perforated sheet, and (iii) a plurality of apertures through the perforated sheet.

In embodiments, the central portion of the perforated sheet is separated from the tubular wall of the base, and the outer portion of the spreader is separated from the outer portion of the perforated sheet.

In embodiments, a mixture of air and gaseous fuel flows into the inlet of the passageway of the base, through the passageway, out of the outlet of the passageway, through the plurality of apertures of the perforated sheet, and through the plurality of apertures of the spreader. A velocity of the mixture of air and gaseous fuel before the mixture of air and gaseous fuel flows through the plurality of apertures of the perforated sheet is greater than a velocity of the mixture of air and gaseous fuel after the mixture of air and gaseous fuel flows through the plurality of apertures of the perforated sheet.

In embodiments, the apertures of the plurality of apertures through the perforated sheet each have a diameter of 1.9 mm to 2.1 mm. In embodiments, the perforated sheet has a thickness that is 0.8 mm to 1.0 mm.

According to yet another aspect of the present disclosure, a burner assembly comprises: (i) an outlet of a passageway; (ii) a spreader comprising a plurality of apertures; and (iii) a perforated sheet disposed between the outlet of the passageway and the spreader, the perforated sheet comprising a plurality of apertures. The burner assembly is configured to direct a mixture of air and gaseous fuel exiting the outlet of the passageway through the plurality of apertures of the perforated sheet and then through the plurality of apertures of the spreader.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

Figure 1A:
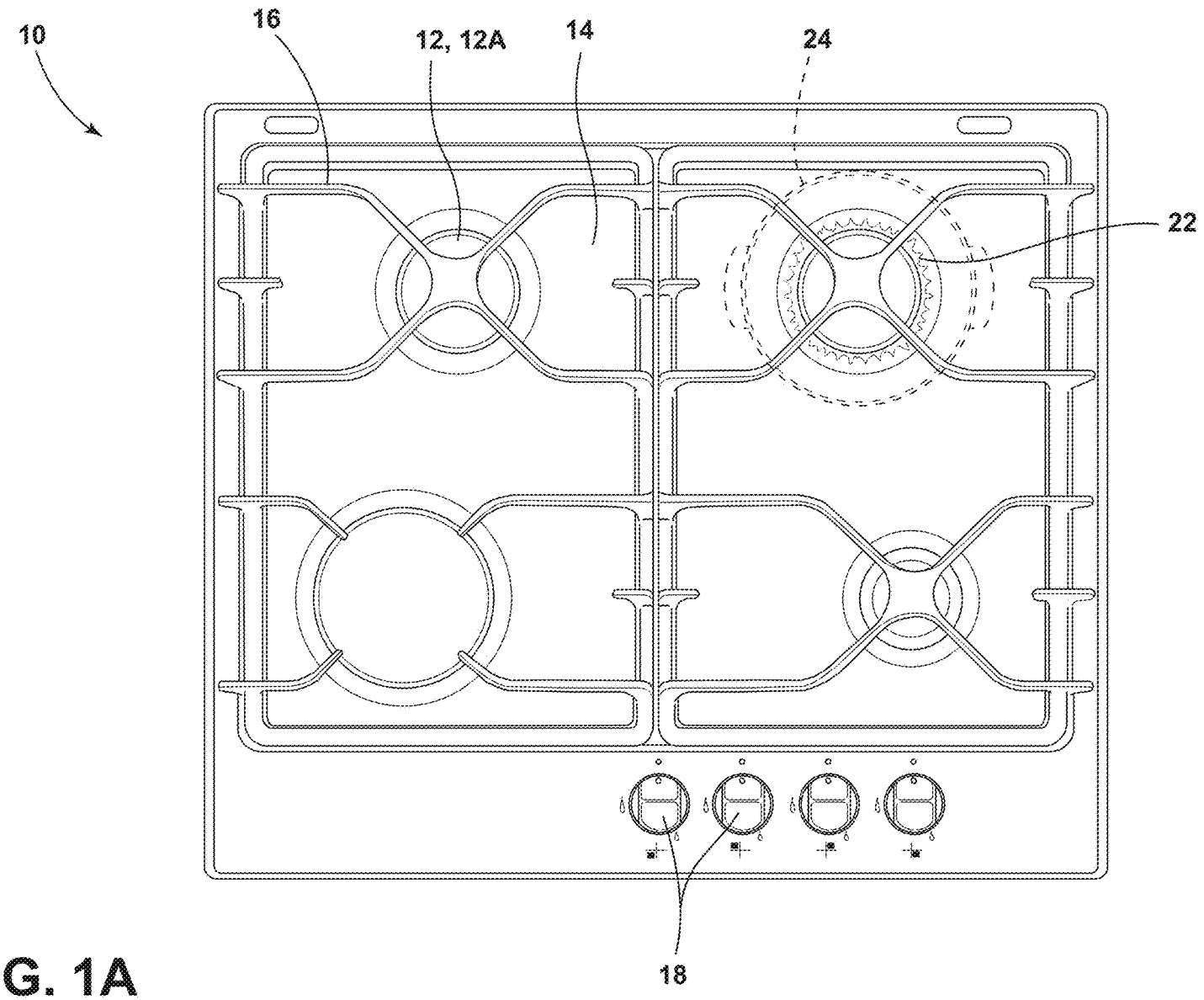
FIG. 1A is an overhead view of a cooktop including one or more embodiments of a burner assembly of the present disclosure.

Referring to FIG. 1A, a cooktop 10 includes a burner assembly 12, 12A, a top wall 14, a grate 16 disposed above the burner assembly 12 and set upon the top wall 14, and a control 18 for the burner assembly 12, 12A. In the illustrated embodiment, the cooktop 10 includes four of the burner assemblies 12, 12A and four of the controls 18. One of the controls 18 is configured to control one of the burner assemblies 12, 12A. The burner assembly 12, 12A extends through an aperture 20 in the top wall 14, and part of the burner assembly 12, 12A is disposed above the top wall 14 and part of the burner assembly 12, 12A is disposed beneath the top wall 14. The burner assembly 12, 12A produces a flame 22. The grate 16 permits a cooking vessel 24 to be set upon the grate 16 to receive heat from the flame 22 that the burner assembly 12, 12A produces beneath the cooking vessel 24.

Figure 1B:
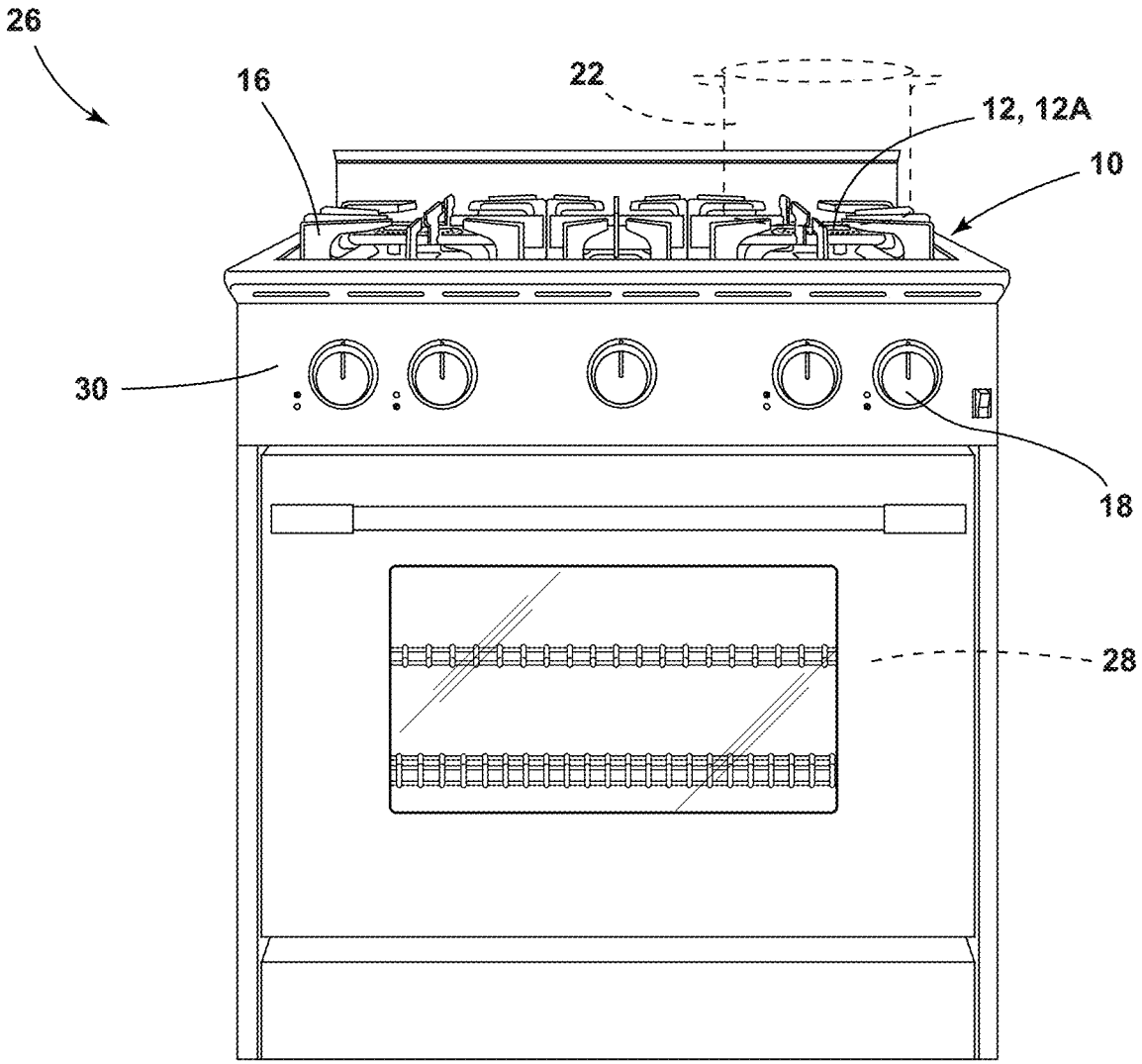
FIG. 1B is a range with a cooktop that includes one or more embodiments of a burner assembly of the present disclosure.

Referring now to FIG. 1B, the cooktop 10 with the burner assembly 12, 12A is illustrated as a component of a range 26. The range 26 further includes an oven 28. The cooktop 10 is disposed above the oven 28. The control 18 for the burner assembly 12, 12A can be disposed at a front portion 30 of the range 26. In use, the burner assembly 12, 12A produces a flame 22 that heats the contents of the cooking vessel 24. Although the cooktop 10 and the range 26 are provided as example uses for the burner assemblies 12, 12A described herein, the burner assemblies 12, 12A can be a component of any cooking appliance.

Referring now to FIGS. 2-13, the burner assembly 12 is disposed over a bottom 32 of the cooktop 10. The burner assembly 12 includes a spreader 34 (see particularly FIGS. 5-7). As will be further discussed, the spreader 34 spreads a mixture of air and gaseous fuel 35 outward from an axis 36 before the mixture of air and gaseous fuel 35 combusts into the flame 22. In embodiments, the spreader 34 has a disc shape. The spreader 34 includes a top 38 and a bottom 40. The bottom 40 faces and contacts the mixture of air and gaseous fuel 35 before the mixture of air and gaseous fuel 35 combusts into the flame 22.

The spreader 34 includes a central portion 42 through which the axis 36 extends. The central portion 42 has a bottom surface 44 at the bottom 40 of the spreader 34. In embodiments, the bottom surface 44 is perpendicular to the axis 36 or approximately perpendicular to the axis 36 (i.e., forming an angle of 70 degrees to 90 degrees relative to the axis 36). The bottom surface 44 of the central portion 42 faces and contacts the mixture of air and gaseous fuel 35 before the mixture of air and gaseous fuel 35 combusts, and spreads the mixture of air and gaseous fuel 35 outward from the axis 36. The central portion 42 has a top surface 46. In embodiments, the top surface 46 is planar. In embodiments, the top surface 46 is perpendicular to the axis 36 or approximately perpendicular to the axis 36 (i.e., forming an angle of 70 degrees to 90 degrees relative to the axis 36).

The spreader 34 further includes a plurality of apertures 48 through the spreader 34. That is, the plurality of apertures 48 extend through the spreader 34 from the bottom 40 to the top 38 of the spreader 34. The plurality of apertures 48 are disposed further away from the axis 36 than the central portion 42. In embodiments, the plurality of apertures 48 are disposed radially around the axis 36. As further discussed below, the mixture of air and gaseous fuel 35 flows through plurality of apertures 48.

In embodiments, the plurality of apertures 48 each have a radial length 50 between a beginning radius 52 and an ending radius 54 from the axis 36. In such embodiments, the plurality of apertures 48 each have a width 56 orthogonal to the radial length 50, and the width 56 is less than the radial length 50. In embodiments, the radial length 50 is 3 to 8 times the width 56.

The spreader 34 further includes a plurality of spaced fingers 58. Each of the plurality of spaced fingers 58 are separated by one of the plurality of apertures 48 (i.e., finger 58, aperture 48, finger 58, aperture 48, in sequence, and so on).

The spreader 34 further includes a ridge 60 at the bottom 40. The ridge 60 projects from the bottom surface 44. The ridge 60 is disposed further away from the axis 36 than the central portion 42 but closer to the axis 36 than the plurality of apertures 48. In embodiments, the ridge 60 is annular, and has a radius 62 from the axis 36 that is constant or approximately constant (e.g., deviation of less than 5% from a median of the radius 62). In embodiments, the ridge 60 separates the central portion 42 from the plurality of apertures 48 at the bottom 40 of the spreader 34. In embodiments, the ridge 60 forms a contiguous perimeter around the bottom surface 44 of the central portion 42.

The ridge 60 includes an inner surface 64 closest to the axis 36. In embodiments, the inner surface 64 forms an angle $\alpha$ that is obtuse (e.g., 90 degrees<angle $\alpha$<120 degrees) relative to the bottom surface 44. In embodiments, the angle $\alpha$ is right or approximately right (e.g., 85 degrees angle $\alpha$ 95 degrees). In embodiments, the inner surface 64 is parallel to the axis 36 or at least approximately parallel to the axis 36 (i.e., forms an angle of −10 degrees to 10 degrees relative to the axis 36). The inner surface 64 is disposed at, and defines, the radius 62 of the ridge 60 from the axis 36.

In embodiments, the spreader 34 further includes an outer portion 66. The plurality of spaced fingers 58 bridges the central portion 42 to the outer portion 66. The outer portion 66 is disposed further away from the axis 36 than the plurality of apertures 48 and the ridge 60. The outer portion 66 includes a lateral edge 68 that defines a perimeter of the spreader 34 relative to the axis 36. In embodiments, the outer portion 66 includes a top surface 70 that is perpendicular or at least approximately perpendicular to the axis 36 (i.e., forms an angle of 80 degrees to 100 degrees relative to the axis 36). In embodiments, the lateral edge 68 has a radius 72 from the axis 36 that is constant or approximately constant (e.g., deviation of less than 5% from a median of the radius 72). In embodiments, the plurality of spaced fingers 58 project laterally away and downward from the central portion 58, with the result being that top surface 46 of the spreader 34 at the central portion 42 is elevated higher than the top surface 70 of the spreader 34 at the outer portion 66.

In embodiments, the spreader 34 includes a ridge 74 at the top 34 of the spreader 34 that is contiguous with or proximate the edge 68. The ridge 74 extends upward from the top surface 70. In embodiments, the spreader 34 includes apertures 76, 78 through which a temperature sensor 80 (see FIG. 2) and an ignition electrode 82 extend, respectively. In embodiments, the ridge 74 is annular about the axis 36, with the exceptions of the ridge 74 near the apertures 76, 78. In embodiments, the outer portion 66 includes a bottom surface 84 that is perpendicular to the axis 36 or approximately perpendicular to the axis 36 (i.e., forming an angle of 80 degrees to 100 degrees relative to the axis 36). In embodiments, the spreader 34 includes a plurality of apertures 86 through the spreader 34 at the outer portion 66, and an annular ridge 88 surrounding each of the plurality of apertures 86, with the annular ridge 88 extending from the bottom surface 84.

In embodiments, the spreader 34 further includes a second ridge 90 at the bottom 40 and at the outer portion 66. The second ridge 90 is disposed further away from the axis 36 than the ridge 60. The second ridge 90 can be annular about the axis 36. The second ridge 90 has an inner surface 92 that faces the axis 36. The inner surface 92 can be parallel to the axis 36 or approximately parallel to the axis 36 (i.e., forming an angle of −10 degrees to 10 degrees relative to the axis 36). The inner surface 92 of the second ridge 90 has a radius 94 that is equal to or approximately equal to the ending radius 54 of the plurality of apertures 48. The second ridge 90 further includes a bottom surface 96 just further away from the axis 36 than the inner surface 92. The bottom surface 96 can be perpendicular to the axis 36 or approximately perpendicular to the axis 36 (i.e., forming an angle of 80 degrees to 100 degrees relative to the axis 36). The second ridge 90 further includes an outer surface 98 facing away from the axis 36, and further away from the axis 36 than the inner surface 92. The outer surface 98 can be parallel to the axis 36 or approximately parallel to the axis 36 (i.e., forming an angle of −10 degrees to 10 degrees relative to the axis 36).

In embodiments, the burner assembly 12 further includes a burner cap 100 (see particularly FIGS. 8 and 9), through which the axis 36 extends. The burner cap 100 is disposed over the spreader 34. The burner cap 100 is also similar to a disc in shape. The burner cap 100 includes a top 102 and a bottom 104, which faces the spreader 34.

The burner cap 100 includes a central portion 106. The axis 36 extends through the central portion 106. The central portion 106 includes a bottom surface 108 at the bottom 104 that faces the top surface 70 of the spreader 34, and a top surface 110. In embodiments, the bottom surface 108 is planar and is perpendicular to the axis 36. In embodiments, the top surface 110 is planar and is perpendicular to the axis 36. In embodiments, the bottom surface 108 and the top surface 110 are approximately perpendicular to the axis 36 (i.e., forms an angle of 80 degrees to 100 degrees relative to the axis 36).

The burner cap 100 further includes an outer portion 112. The outer portion 112 is disposed further away from the axis 36 than the central portion 106. The outer portion 112 is disposed over the outer portion 66 of the spreader 34. The outer portion 66 includes a top surface 114 at the top 102, and a bottom surface 116 at the bottom 104 that faces the top surface 70 of the outer portion 66 of the spreader 34. In embodiments, the bottom surface 116 is planar and is perpendicular to the axis 36. In embodiments, the top surface 114 is planar and is perpendicular to the axis 36. In embodiments, the bottom surface 116 and the top surface 114 are approximately perpendicular to the axis 36 (i.e., forming an angle of 80 degrees to 100 degrees relative to the axis 36).

In embodiments, the outer portion 112 of the burner cap 100 further includes a flange 118. The flange 118 radially surrounds the edge 68 of the spreader 34. The flange 118 includes an inner surface 120. The inner surface 120 faces the edge 68 of the spreader 34. In embodiments, the inner surface 120 is parallel or approximately parallel to the axis 36 (e.g., forms an angle of −10 degrees to 10 degrees relative to the axis 36). Thus, the burner cap 100 partially encases the spreader 34.

In embodiments, the burner assembly 12 further includes one or more gaskets 122 (see particularly FIG. 3) disposed between the burner cap 100 and the spreader 34. For example, the one or more gaskets 122 can be disposed between the bottom 104 of the burner cap 100 and the top 34 of the spreader 34. In embodiments, the spreader 34 includes recessed sections 124 into the outer portion 66 at the top 34 of the spreader 34. The recessed sections 124 are disposed closer to the axis 36 than the ridge 74 but further from the axis 36 than the plurality of apertures 48. Each recessed section 124 can be semi-annular in shape around the axis 36. The one or more gaskets 122 include apertures 126 that cooperate with the apertures 86 through the spreader 34 at the outer portion 66 of the spreader 34 within the recessed portion 124. Fasteners (not illustrated) allow fastening of the one or more gaskets 122 to the spreader 34 via the apertures 86, 126.

The burner cap 100 further includes a middle portion 128. The middle portion 128 is disposed further away from the axis 36 than the central portion 106 of the burner cap 100 but closer to the axis 36 than the outer portion 112 of the burner cap 100. The middle portion 128 of the burner cap 100 is disposed over the plurality of apertures 48 and plurality of spaced fingers 58 of the spreader 34. The middle portion 128 of the burner cap 100 includes a top surface 130 at the top 102 and a bottom surface 132 at the bottom 104, which faces the spreader 34. In embodiments, the bottom surface 132 of the middle portion 128 forms an obtuse angle $\alpha$ relative to the bottom surface 108 of the central portion 106, such as 135 degrees<angle $\alpha$<180 degrees. In embodiments, the bottom surface 132 of the middle portion 128 forms a reflex angle $\beta$ relative to the bottom surface 116 of the outer portion 112 of the burner cap 100, such as 180 degrees<angle $\beta$<235 degrees. In embodiments, the top surface 130 of the middle portion 128 forms a reflex angle $\gamma$ relative to the top surface 110 of the central portion 106, such as 180 degrees<angle $\gamma$<235 degrees. In embodiments, the top surface 130 of the middle portion 128 forms an obtuse angle $\delta$ relative to the top surface 114 of the outer portion 112 of the burner cap 100, such as 135 degrees<angle $\delta$<180 degrees. Thus, in embodiments, the central portion 106 of the burner cap 100 is elevated higher than the middle portion 128, which is elevated higher than the outer portion 112.

The burner cap 100 further includes a plurality of apertures 134 through the middle portion. The plurality of apertures 134 are open at the top 102 and the bottom 104 of the burner cap 100. As further discussed below, a mixture of air and gaseous fuel 35 flows through the plurality of apertures 134 through the burner cap 100.

Figure 2:
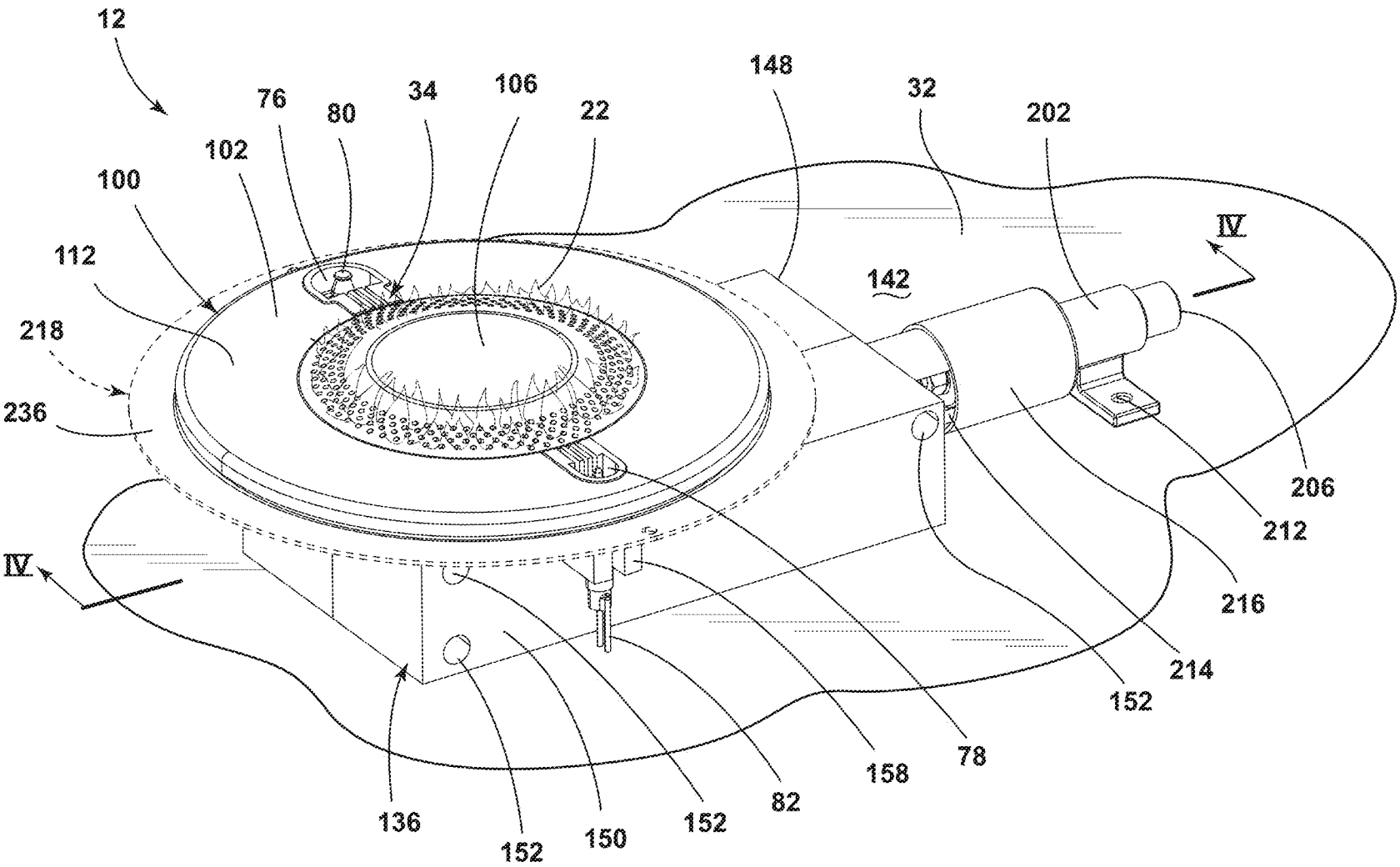
FIG. 2 is a perspective view of a burner assembly of the present disclosure, illustrating the burner assembly producing a flame above a plurality of apertures through a burner cap.
Figure 3:
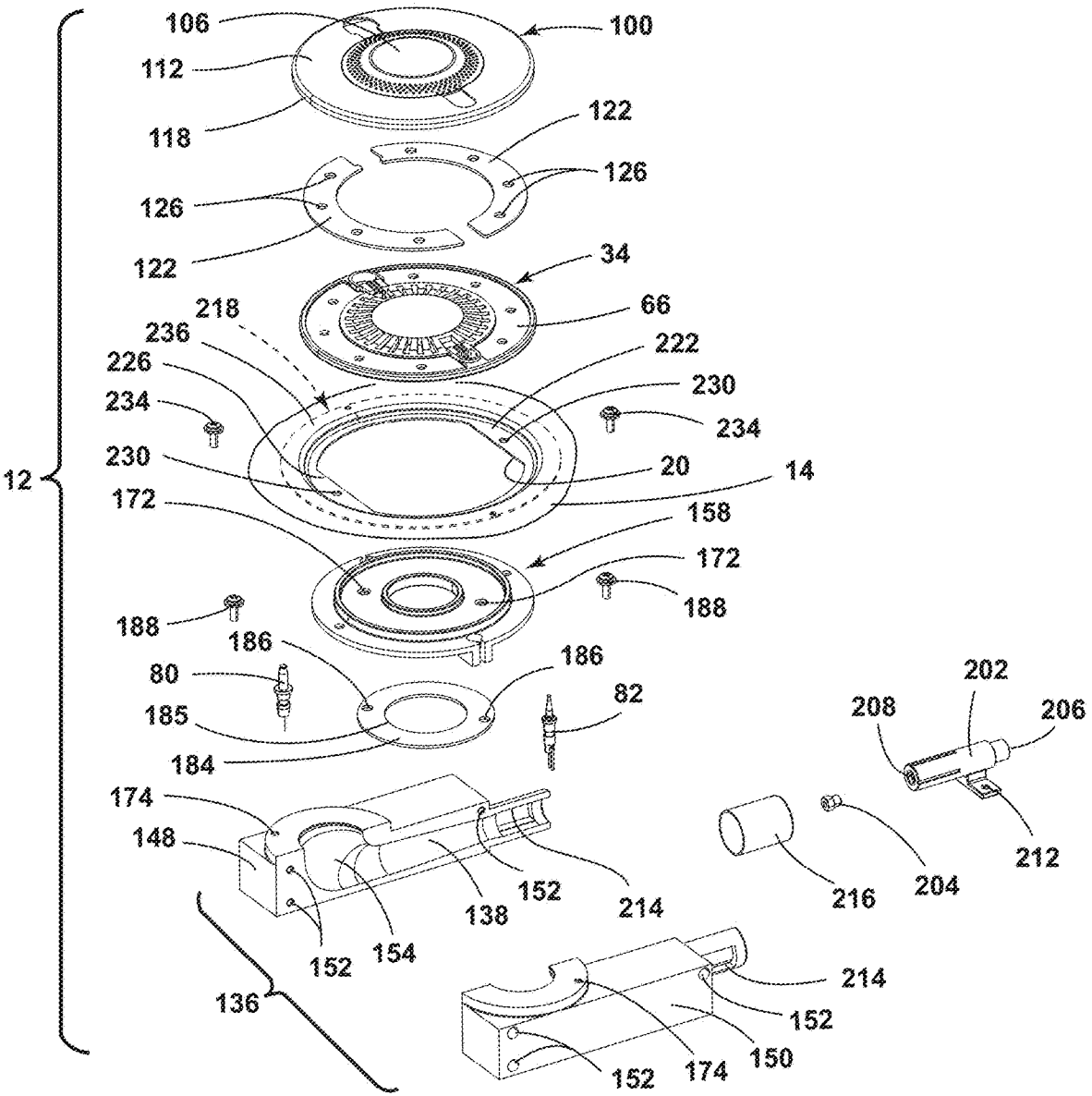
FIG. 3 is a blown-up perspective view of the burner assembly of FIG. 2, illustrating a spreader below the burner cap, a base below the spreader, and a venturi below the base to provide a mixture of air and gaseous fuel to the spreader.
Figure 4:
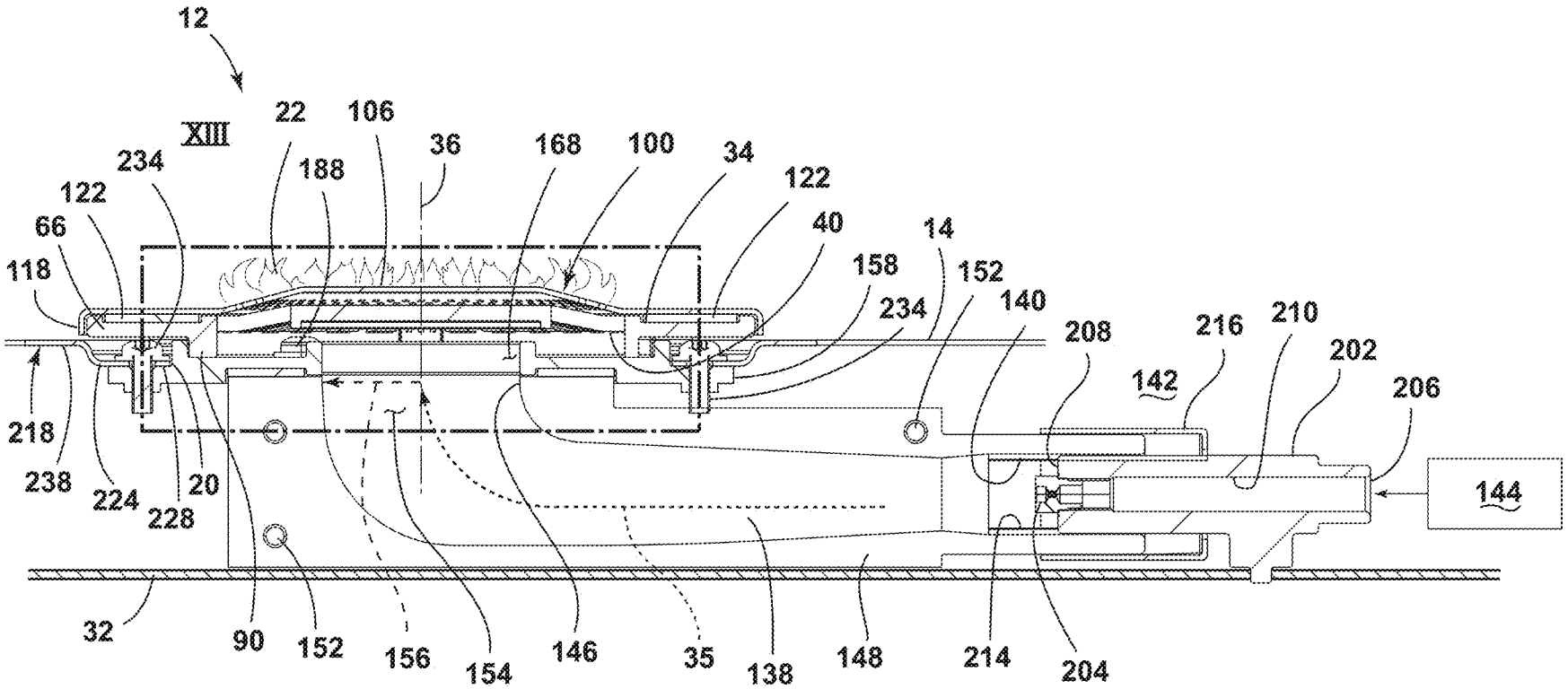
FIG. 4 is an elevational view of the cross-section of the burner assembly of FIG. 2 taken through line IV-IV of FIG. 2, illustrating an axis extending through the burner cap, the spreader, the base, and an outlet of a passageway of the venturi.
Figure 5:
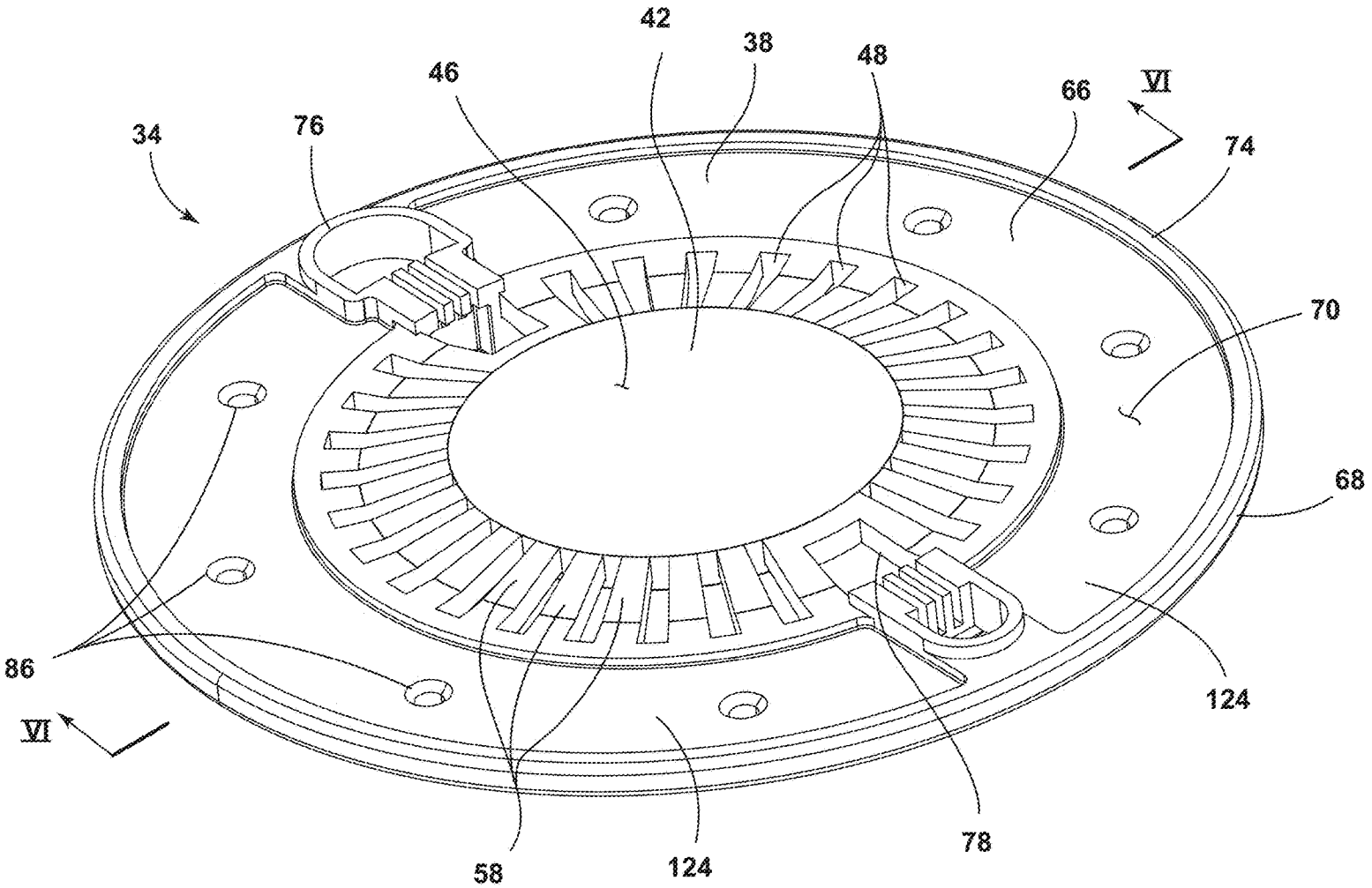
FIG. 5 is a perspective view of the spreader of the burner assembly of FIG. 2, illustrating a central portion, an outer portion, and a plurality of apertures separated by a plurality of spaced fingers disposed between the central portion and the outer portion.
Figure 6:
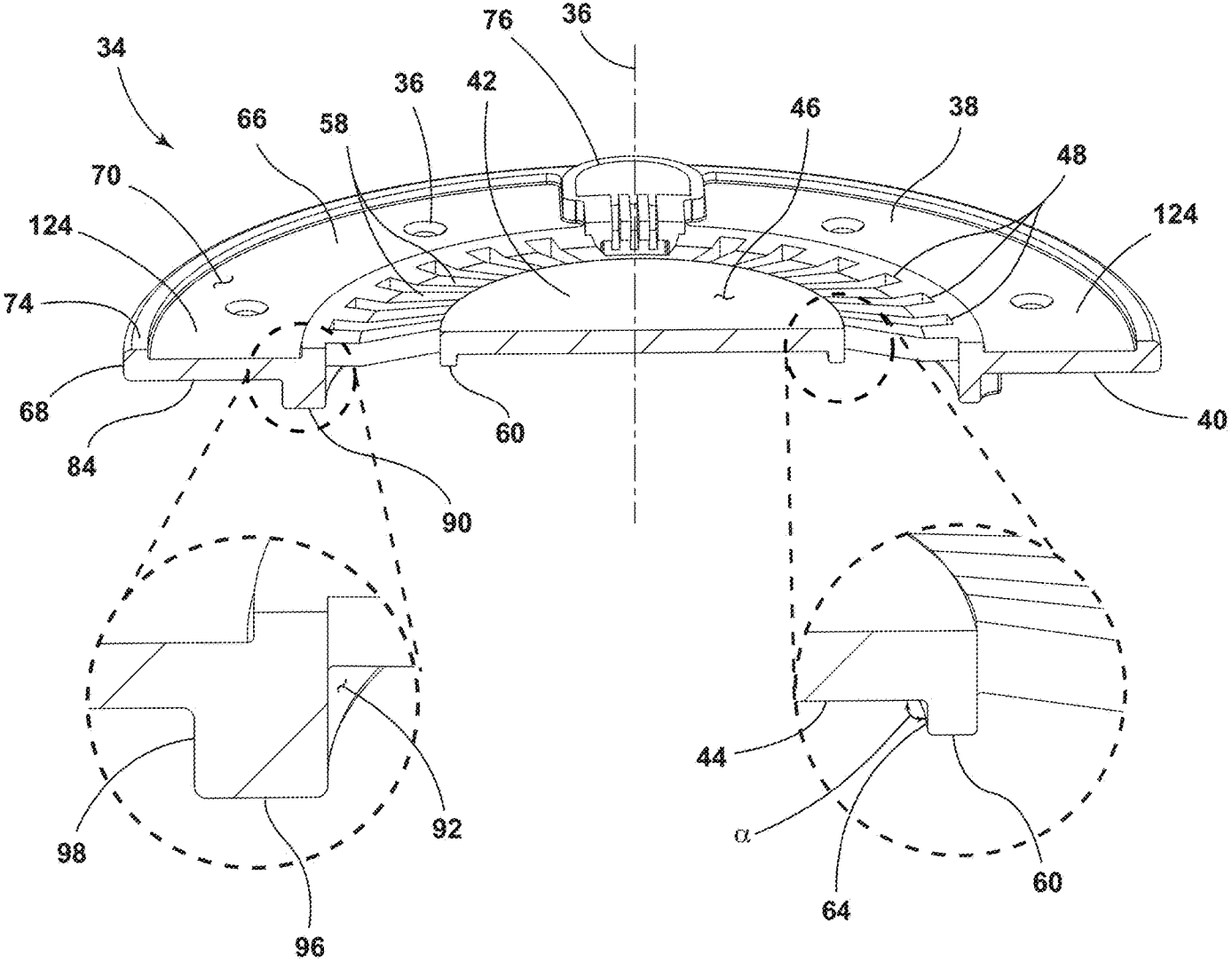
FIG. 6 is a cross-sectional view of the spreader of the burner assembly of FIG. 2, illustrating a ridge extending downward from a bottom surface of the central portion and extending radially around the axis, with the plurality of apertures through the spreader being disposed further from the axis than the ridge.
Figure 7:
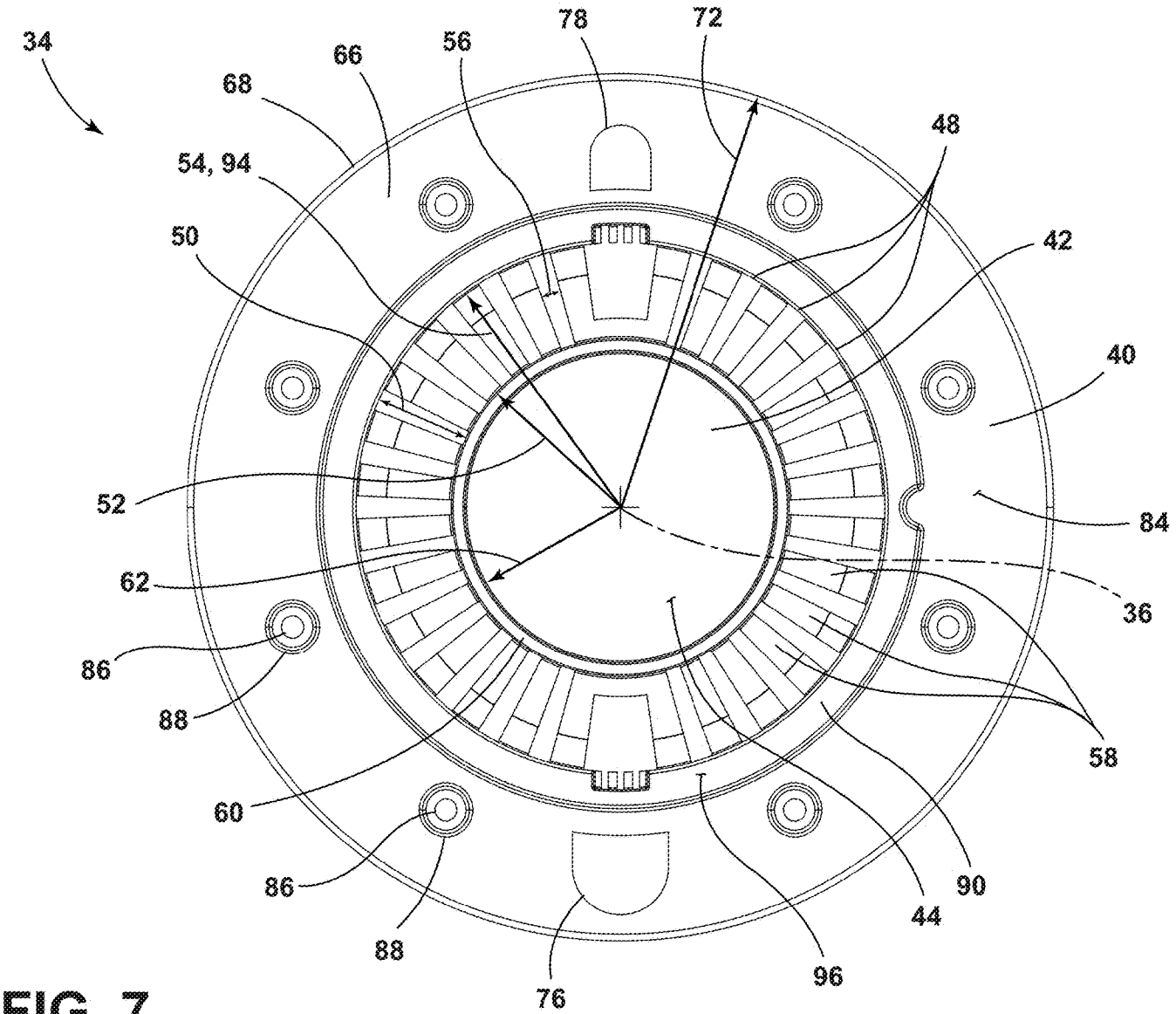
FIG. 7 is a bottom view of the spreader of the burner assembly of FIG. 2, illustrating a second ridge extending downward from the a bottom surface of the outer portion of the spreader, a purpose of the second ridge being to cooperate with the base to limit flow of a mixture of air and gaseous fuel laterally away from the axis to force the mixture of air and gaseous fuel upward through the plurality of apertures of the spreader.
Figure 8:
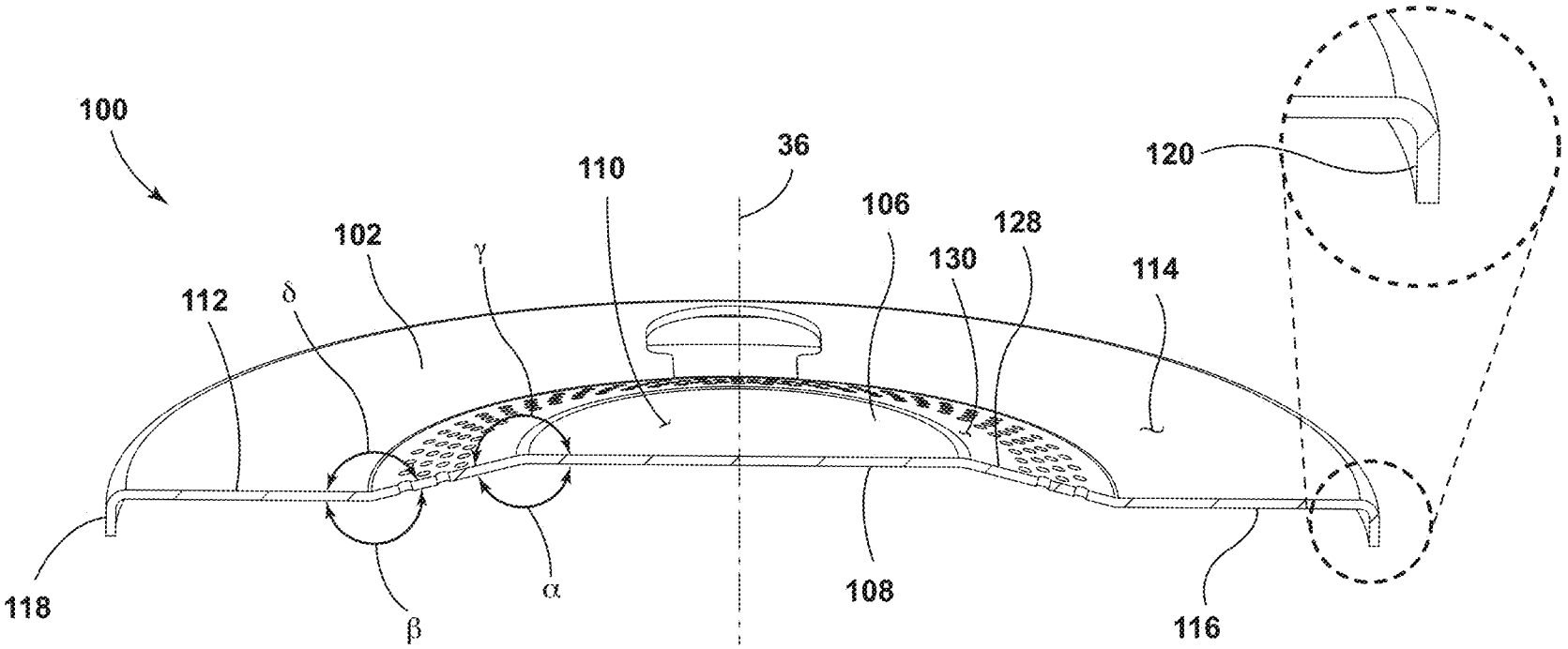
FIG. 8 is a cross-sectional view of the burner cap of the burner assembly of FIG. 2, illustrating a central portion about the axis, an outer portion about the axis disposed further away from the axis than the central portion, and a middle portion radially between the central portion and the outer portion, the middle portion including a plurality of apertures through which the mixture of air and gaseous fuel flows to become combusted into the flame.
Figure 9:
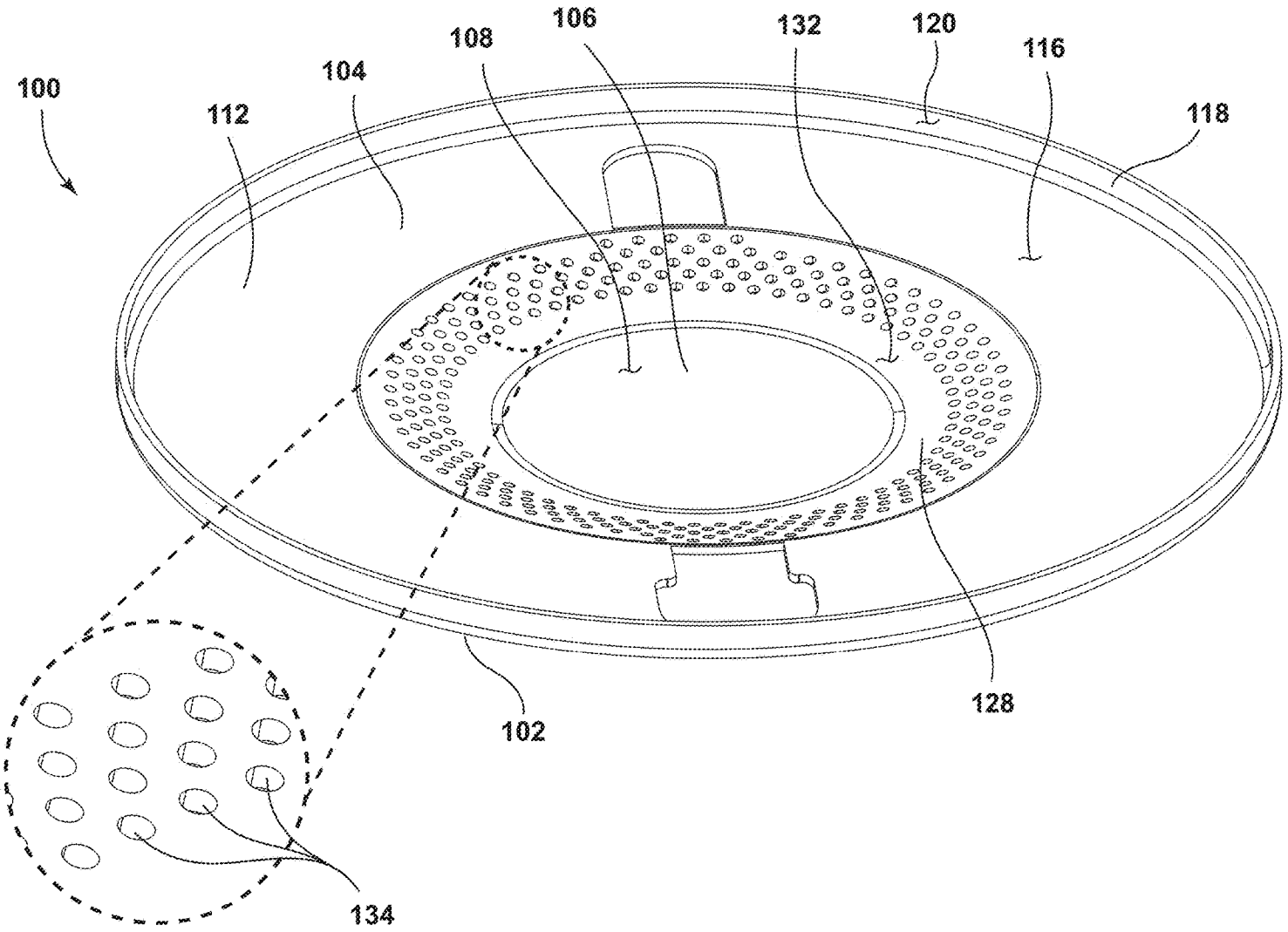
FIG. 9 is a bottom perspective view of the burner cap of the burner assembly of FIG. 2, illustrating a flange extending downward from the bottom surface of the outer portion, and a purpose of the flange being to surround an edge of the spreader.

In embodiments, the burner assembly 12 further includes a venturi 136 (see particularly FIGS. 2-4). The venturi 136 includes a passageway 138. As further described below, the passageway 138 is to deliver the mixture of air and gaseous fuel 35 to the spreader 34. The venturi 136 further includes an inlet 140 into the passageway 138. The inlet 140 is in communication with air 142 and gaseous fuel 144. The air 142 can be below the top wall 14 and above the bottom 32 of the cooktop 10 between which the inlet 140 is disposed. The venturi 136 further includes an outlet 146 of the passageway 138. The outlet 146 of the passageway 138 is in fluid communication with the plurality of apertures 48 of the spreader 34. As further discussed below, the mixture of air and gaseous fuel 35 flows through the passageway 138 of the venturi 136, out the outlet 146 of the venturi 136, and out the plurality of apertures 48 of the spreader 34. The axis 36 extends into the outlet 146 of the passageway 138. In embodiments, the venturi 136 comprises a first piece 148 and a second piece 150. The first piece 148 and the second piece 150 include cooperating apertures 152 to allow the fastening together of the first piece 148 and the second piece 150.

The venturi 136 includes an internal surface 154 that defines the passageway 138. The internal surface 154 at the outlet 146 of the venturi 136 has a radius 156 from the axis 36. In embodiments, the radius 156 of the internal surface 154 is less than the ending radius 54 of the plurality of apertures 48 of the spreader 34. In embodiments, the radius 156 of the internal surface 154 is less than the radius 62 of the inner surface 64 of the ridge 60 of the spreader 34.

Figure 10:
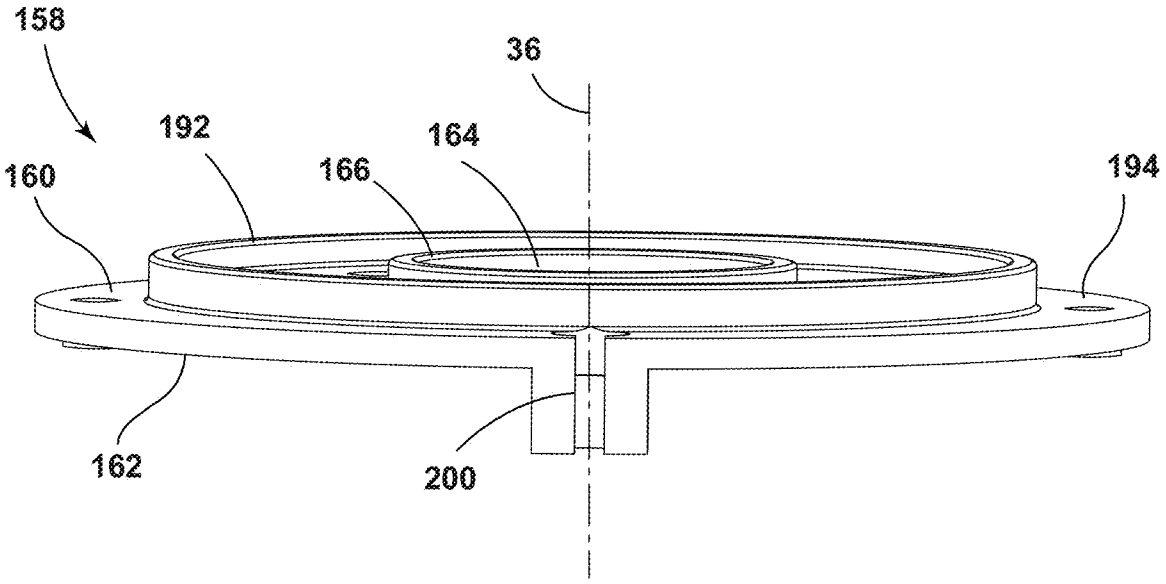
FIG. 10 is a side view of the base of the burner assembly of FIG. 2, illustrating a ridge extending upward at a top of the base and a second annular ridge extending upward at the top further away from the axis than the ridge, the annular ridge being closer to the axis than the ridge of the spreader and the second ridge surrounding the second ridge of the spreader.
Figure 11:
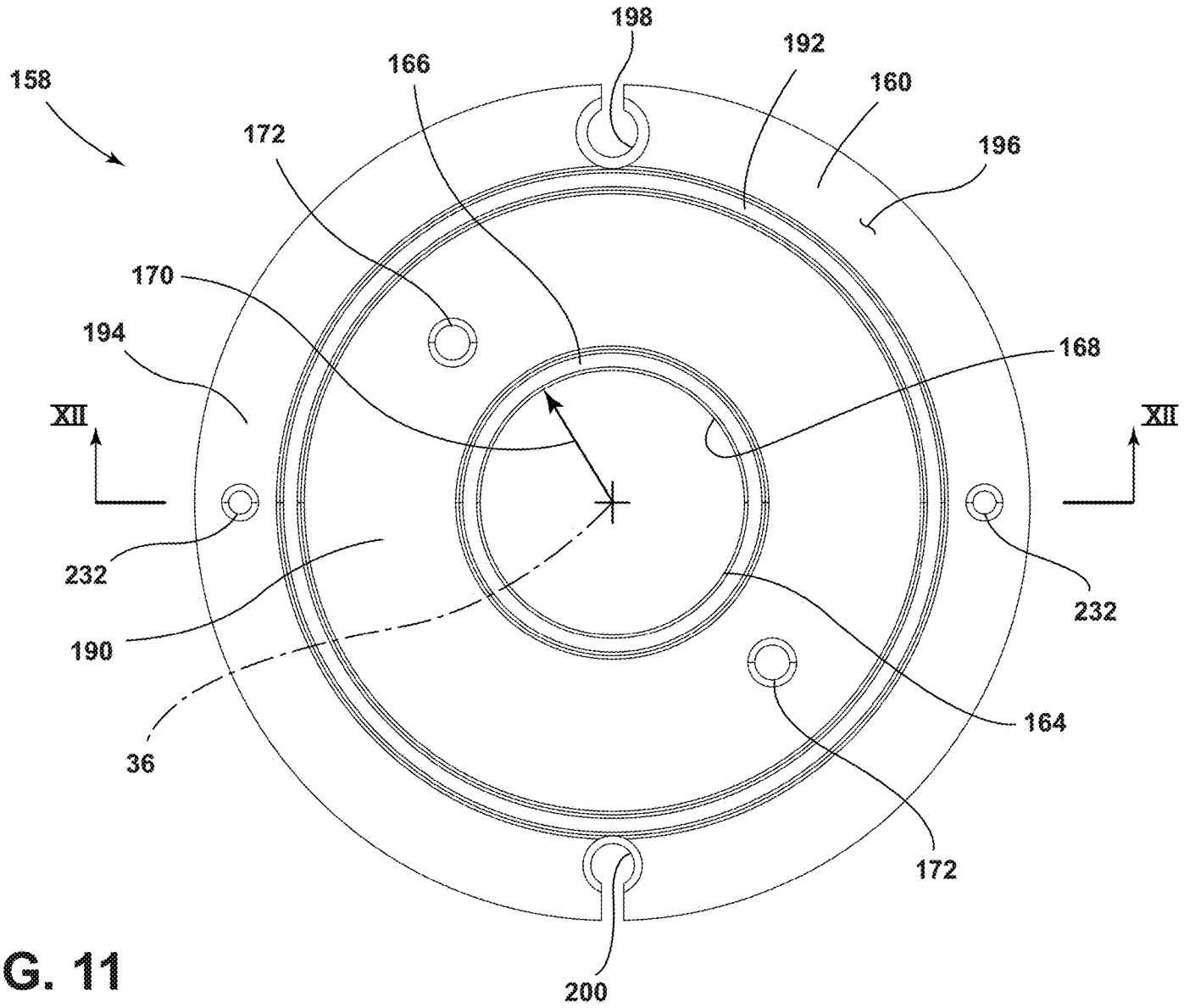
FIG. 11 is a top view of the base of the burner assembly of FIG. 2, illustrating the base including a central aperture, a purpose of the central aperture being to cooperate with the passageway of the venturi to deliver the mixture of air and gaseous fuel to a central portion of the spreader, which then forces the mixture laterally between the spreader and the base.
Figure 12:
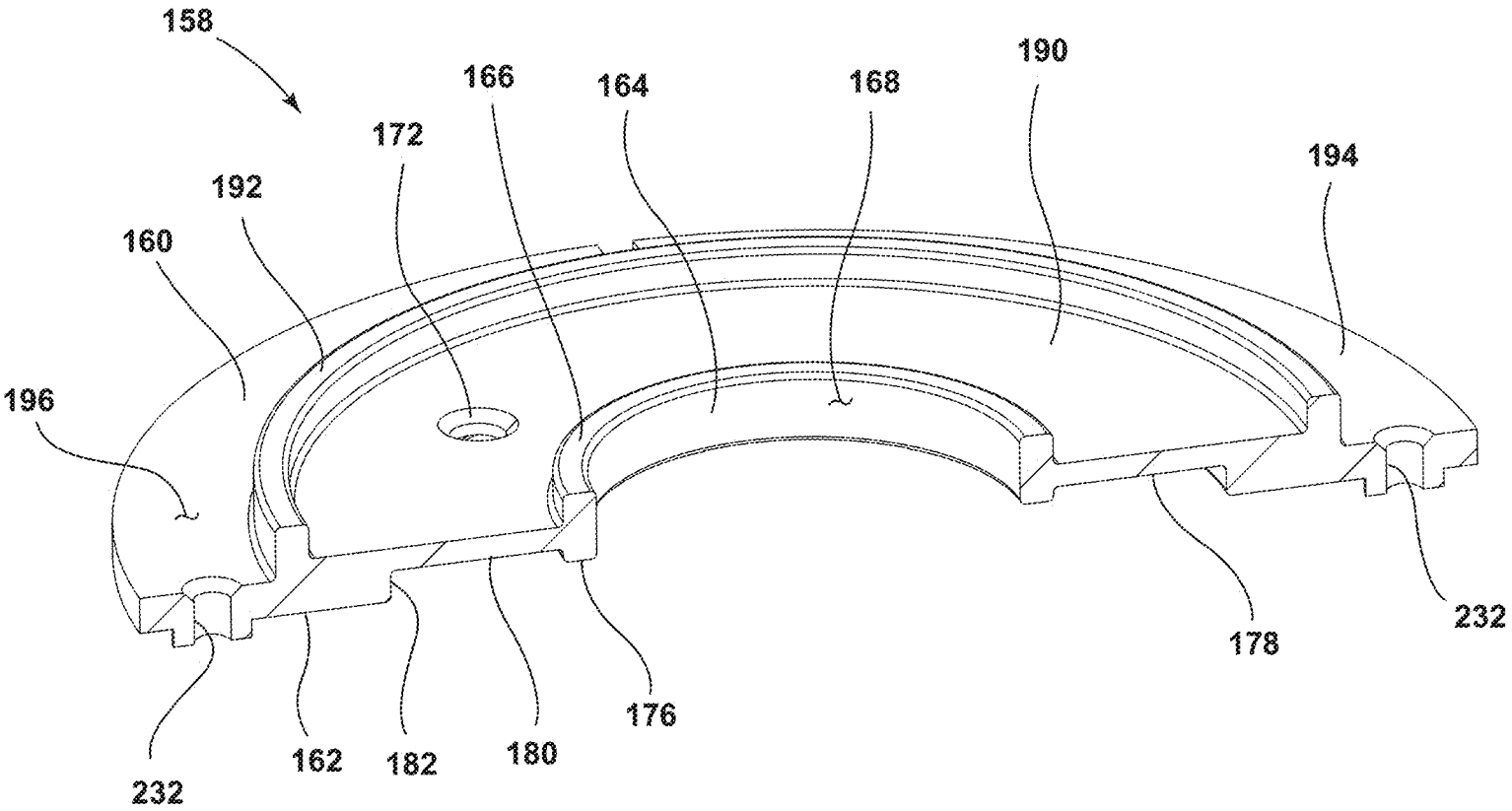
FIG. 12 is perspective cross-sectional view of the base of the burner assembly of FIG. 2, illustrating the base including a ridge extending from the bottom around the central aperture, a purpose of the ridge being to cooperate with the passageway of the venturi to guide the mixture of air and gaseous fuel through the central aperture of the base.

In embodiments, the burner assembly 12 further includes a base 158 disposed between the spreader 34 and the venturi 136 (see particularly FIGS. 10-12). The base 158 takes a disc-like appearance, with a top 160 facing away from the venturi 136, a bottom 162 facing the venturi 136, and a central aperture 164. The axis 36 extends through the central aperture 164 of the base 158. The central aperture 164 is in fluid communication with the passageway 138 of the venturi 136. The bottom surface 44 of the central portion 42 of the spreader 34 is disposed over the central aperture 164 of the base 158.

The base 158 further includes an annular ridge 166 at the top 160 around and defining the central aperture 164. The annular ridge 166 is disposed closer to the axis 36 than the ridge 60 projecting from the bottom surface 44 of the spreader 34. The base 158 includes an inner surface 168 that defines the central aperture 164. In embodiments, the inner surface 168 is parallel to the axis 36. The inner surface 168 has a radius 170 from the axis 36.

The base 158 is disposed over the venturi 136. The base 158 is attached to the venturi 136. The base 158 includes apertures 172. The venturi 136 includes cooperating apertures 174 at the first piece 148 and the second piece 150, respectively. In embodiments, the radius 170 of the inner surface 168 of the base 158 is approximately equal to the radius 156 of the internal surface 154 of the passageway 138 of the venturi 136 at the outlet 146.

The base 158 further includes an annular ridge 176 at the bottom 162 around and further defining the central aperture 164. The annular ridge 176 sits upon the venturi 136. The base 158 further includes an annular recess 178 at the bottom 162 surrounding the annular ridge 176. The annular recess 178 has a planar surface 180 that is perpendicular to the axis 36 or approximately perpendicular to the axis 36 (i.e., forms an angle of 80 degrees to 100 degrees relative to the axis 36). The base 158 further includes, at the bottom 162, a surface 182 parallel to the axis 36 or approximately parallel to the axis 36 (i.e., forms an angle of −10 degrees to 10 degrees relative to the axis 36) that defines, with the annular ridge 176, the annular recess 178. The surface 182 extends further downward from the planar surface 180 of the annular recess 178 than the annular ridge 176. The surface 182 surrounds the venturi 136 and thus, the base 158 partially encases the venturi 136.

In embodiments, the burner assembly 12 further includes a gasket 184 that is disposed between the base 158 and the venturi 136 (see particularly FIG. 3). The gasket 184 is disposed within the annular recess 178. The gasket 184 includes a central aperture 185 through which the axis 36 extends. The gasket 184 includes apertures 186 cooperating with apertures 172 of the base 158 and apertures 174 of the venturi 136, respectively. Fasteners 188 fasten the base 158, the gasket 184, and venturi 136 together via the apertures 172, 174, and 186.

The base 158 further includes an annular recess 190 at the top 160 that surrounds the annular ridge 166. The base 158 further includes a second annular ridge 192 that surrounds the annular ridge 166 and, with the annular ridge 166, defines the annular recess 190. The annular recess 190 can be planar and perpendicular to the axis 36. The base 158 further includes an outer portion 194 surrounding the second annular ridge 192. The outer portion 194 has a surface 196 perpendicular to the axis 36. The base 158 further includes a slot 198 in which holds the temperature sensor 80, and a slot 200 in which the ignition electrode 82 is held.

The second ridge 90 disposed at the bottom 40 of the spreader 34 is disposed over, and in embodiments sits upon, the top 160 of the base 158 within the annular recess 190 of the base 158. The second ridge 90 is disposed adjacent to the second annular ridge 192 of the base 158. The second ridge 90 is disposed closer to the axis 36 than the second annular ridge 192 of the base 158. The bottom surface 84 at the outer portion 66 of the spreader 34 is disposed over and can sit upon the second annular ridge 192 of the base 158. The outer surface 98 of the second ridge 90 disposed at the bottom 40 of the spreader 34 faces and, in embodiments abuts, the second annular ridge 192 of the base 158.

In embodiments, the burner assembly 12 includes an injector holder 202 and an injector 204 that the injector holder 202 supports (see particularly FIGS. 2-4). The injector holder 202 has a first end 206, a second end 208, and a passageway 210 extending between the first end 206 and the second end 208. The first end 206 of the injector holder 202 connects to the gaseous fuel 144. The injector holder 202 includes apertures 212 to allow fastening of the injector holder 202 to the bottom of the cooktop 10. The injector 204 is disposed within the passageway 210 of the injector holder 202 at the second end 208 of the injector holder 202.

In embodiments, the second end 208 of the injector holder 202 is disposed within the inlet 140 of the venturi 136. In embodiments, the inlet 140 of the venturi 136 includes windows 214 into the passageway 138. In embodiments, the burner assembly 12 includes an air shutter 216. The air shutter 216 is a cylinder that surrounds the inlet 140 of the venturi 136. The air shutter 216 partially covers the windows 214 of the venturi 136 into the passageway 138. Positioning of the air shutter 216 determines how much of the windows 214 are open to draw in air 142 into the passageway 138. Positioning of the air shutter 216 to close more of the windows 214 results in less of the air 142 being drawn into the passageway 138. In contrast, positioning of the air shutter 216 to open more of the windows 214 results in more of the air 142 being drawn into the passageway 138.

In embodiments, the top wall 14 of the cooktop 10 further includes a trim ring portion 218 (see particularly FIGS. 3 and 4). The trim ring portion 218 includes the aperture 20, through which the burner assembly 12 extends, with the venturi 136 disposed above the bottom 32 of the cooktop 10. The axis 36 extends through the aperture 20. The trim ring portion 218 further includes a top 222 and a bottom 224. The trim ring portion 218 further includes an inner portion 226. The inner portion 226 includes a bottom surface 228 at the bottom 224. The bottom surface 228 is perpendicular to the axis 36 or approximately perpendicular to the axis 36 (i.e., forming an angle of 80 degrees to 100 degrees relative to the axis 36). The trim ring portion 218 further includes apertures 230 through the trim ring portion 218 that are disposed at the inner portion 226. The apertures 230 through the trim ring portion 218 cooperate with apertures 232 disposed through the outer portion 194 of the base 158 (see FIG. 11). Fasteners 234 attach the base 158 to the trim ring portion 218 of the top wall 14 of the cooktop 10 via the apertures 230, 232.

The trim ring portion 218 of the top wall 14 of the cooktop 10 further includes an outer portion 236. The outer portion 236 surrounds the inner portion 226. The outer portion 236 is disposed further away from the axis 36 than the inner portion 226. The outer portion 236 includes a bottom surface 238 at the bottom 224. The bottom surface 238 is perpendicular to the axis 36 or approximately perpendicular to the axis 36 (i.e., forming an angle of 80 degrees to 100 degrees relative to the axis 36).

Figure 13:
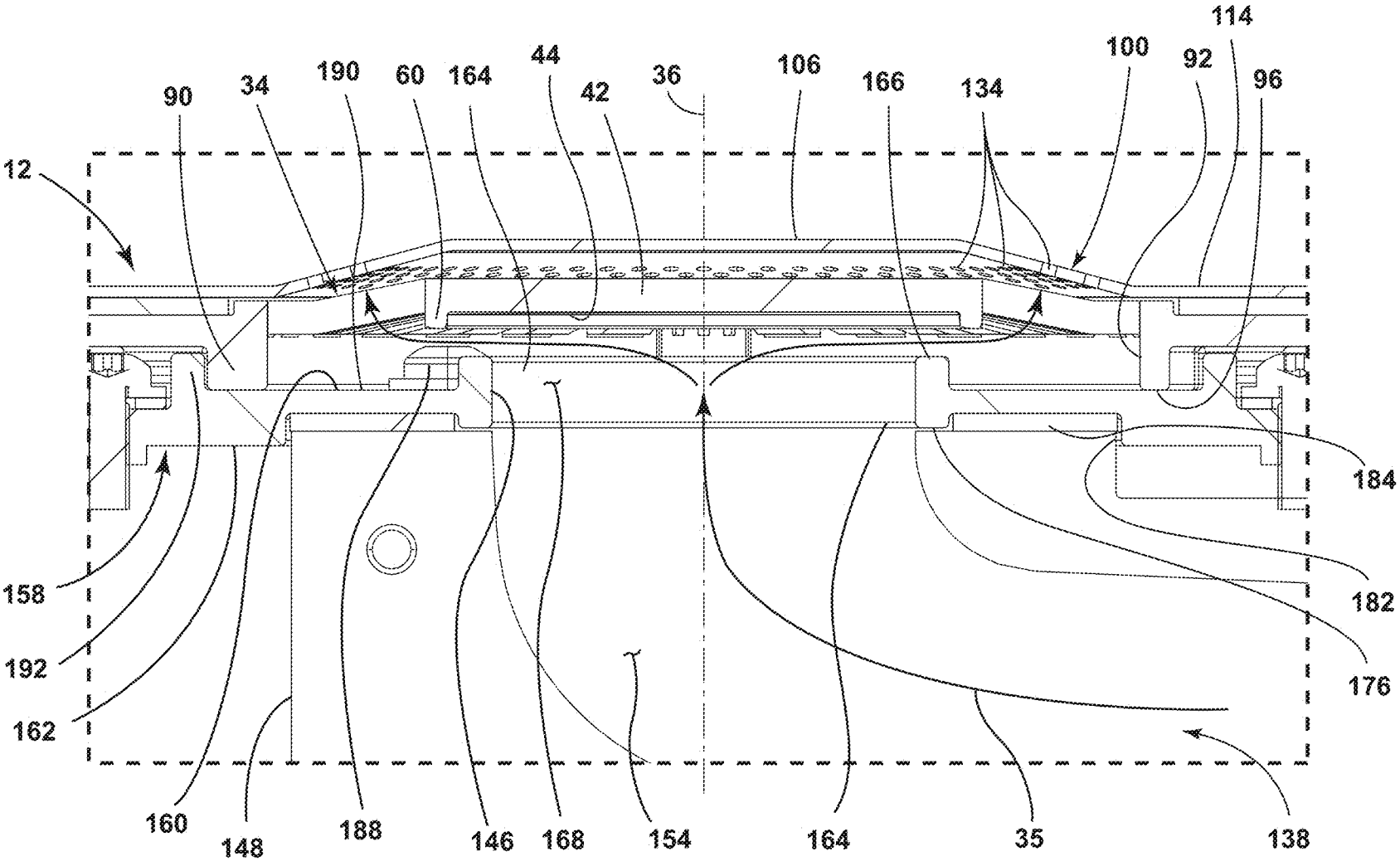
FIG. 13 is a close-up view of area XIII of FIG. 4, illustrating flow of the mixture of air and gaseous fuel from the passageway of the venturi, through the central aperture of the base, radially outward from the axis because of a bottom surface of the central portion of the spreader, between the ridge at the top of the base surrounding the central aperture of the base and the ridge extending downward from the bottom of the spreader, upward through the plurality of apertures of the spreader because the second ridge extending from the bottom of the center and the top of the base between the ridge and the second ridge extending up from the top of the base force the mixture upward through the plurality of apertures, and then through the plurality of apertures of the burner cap.

In use, gaseous fuel 144 enters the passageway 210 of the injector holder 202 (see particularly FIGS. 4 and 13). The gaseous fuel 144 is then injected into the passageway 138 of the venturi 136 at the inlet 140 of the venturi 136 and flows toward the outlet 146 of the venturi 136. The flow of the gaseous fuel 144 pulls the air 142 from exterior of the burner assembly 12 through the windows 214 and into the passageway 138 as well, forming the mixture of air and gaseous fuel 35. The mixture of air and gaseous fuel 35 flows to the outlet 146 of the venturi 136. The mixture of air and gaseous fuel 35 flows through the outlet 146 of the venturi 136. The mixture of air and gaseous fuel 35 then flows through the central aperture 164 of the base 158 generally in a direction parallel with the axis 36. The bottom surface 44 of the central portion 42 of the spreader 34 directs the mixture of air and gaseous fuel 35 laterally outward away from the axis 36. The mixture of air and gaseous fuel 35 flows between the annular ridge 166 at the top 160 of the base 158 and the ridge 60 projecting from the bottom surface 44 of the spreader 34. However, before the mixture of air and gaseous fuel 35 exits the spreader 34 out the plurality of apertures 48 of the spreader 34, the ridge 60 of the spreader 34 reduces a velocity of the mixture of air and gaseous fuel 35. The ridge 60 of the spreader 34 disrupts the flow of the mixture of air and gaseous fuel 35. The mixture of air and gaseous fuel 35 then exits the spreader 34 through the plurality of apertures 48, and then finally through the plurality of apertures 134 of the burner cap 100. Assuming that the mixture of air and gaseous fuel 35 is ignited, then the flame 22 is generated above the plurality of apertures 134 of the burner cap 100. If the mixture of air and gaseous fuel 35 is not already ignited, then the ignition electrode 82 can be activated to ignite the mixture of air and gaseous fuel 35.

In a computer model experiment, the velocity of the mixture of air and gaseous fuel 35 exiting the plurality of apertures 134 of the burner cap 100 when the spreader 34 did not include the ridge 60 was measured. In addition, the velocity of the mixture of air and gaseous fuel 35 exiting the plurality of apertures 134 of the burner cap 100 when the spreader 34 did include the ridge 60 was measured. The measured velocities from the two different scenarios (i.e., without the ridge 60 versus with the ridge 60) were then compared. The velocity of the mixture of air and gaseous fuel 35 exiting the plurality of apertures 134 of the burner cap 100 when the spreader 34 did include the ridge 60 was between 10 percent to 13 percent less than the velocity of the mixture of air and gaseous fuel 35 exiting the plurality of apertures 134 of the burner cap 100 when the spreader 34 did not include the ridge 60. The reduced velocity when the ridge 60 is included reduces the likelihood that the flame 22 would lift up from the burner cap 100.

The spreader 34 with the ridge 60 reduces the velocity of the mixture of air and gaseous fuel 35 without reducing the amount of the air 142 that the injection of the gaseous fuel 144 pulls into the passageway 138 of the venturi 136 through the windows 214. In addition, the problem of the flame 22 lifting is sometimes addressed via the number and configuration of the plurality of apertures 48 of the spreader 34, with the number and configuration being different for each of various different types of gaseous fuels (e.g., methane, butane, propane, etc.). The spreader 34 with the ridge 60 addresses the problem in a different way and this allows the spreader 34 to be utilized with any type of gaseous fuel 144. That reduces cost and complexity. The reduction in the flame 22 lifting also increases efficiency of heating and thus is a more efficient use of the gaseous fuel 144.

Referring now to FIGS. 14-29, another embodiment burner assembly 12A for the cooktop 10 includes a base 300, a spreader 302 disposed above the base 300, and a perforated sheet 304 disposed between the base 300 and the spreader 302.

Figure 16:
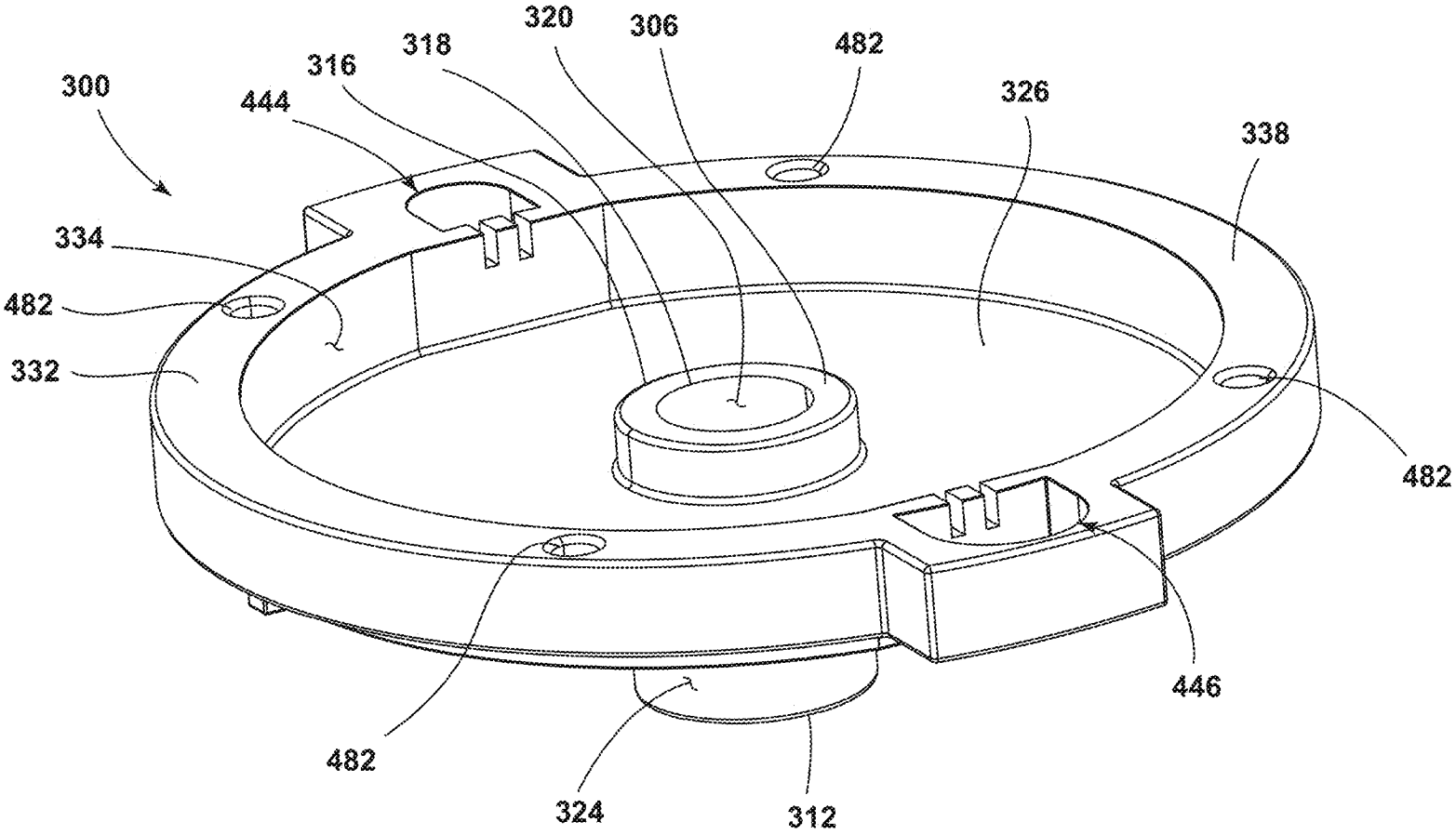
FIG. 16 is a perspective view of the base of the burner assembly of FIG. 14, illustrating a tubular wall forming an outlet of the passageway above a lateral wall that extends radially outward from the tubular wall and an outer wall extending upward from the lateral wall and radially around the axis.
Figure 17:
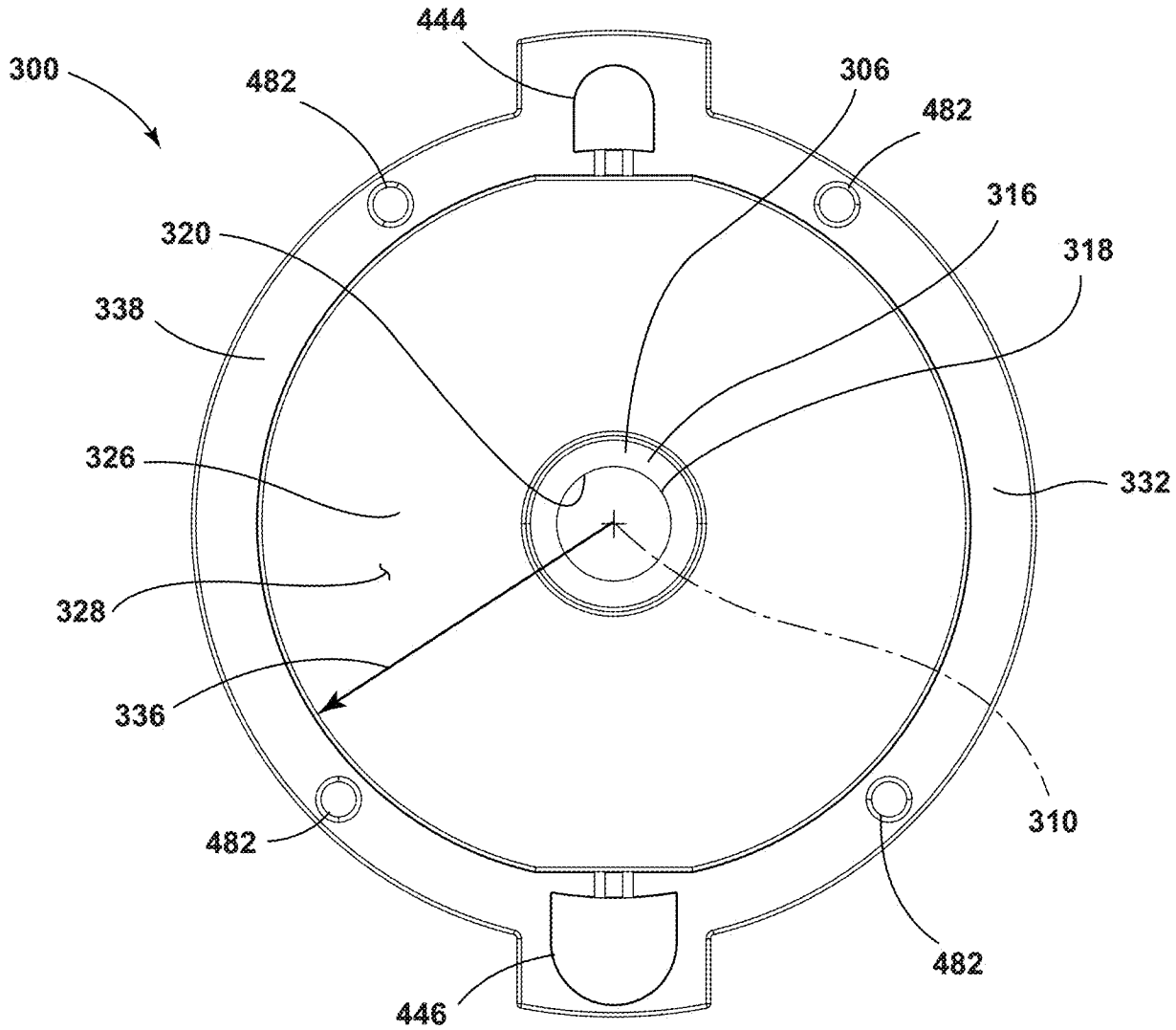
FIG. 17 is a top view of the base of the burner assembly of FIG. 14, illustrating the tubular wall having an interior surface defining the passageway, the lateral wall having a top surface, and the outer wall having a top.

The base 300 includes a tubular wall 306 (see particularly FIGS. 16 and 17). The tubular wall 306 defines a passageway 308. An axis 310 extends through the passageway 308. The tubular wall 306 has a first end 312 that defines an inlet 314 into the passageway 308. The tubular wall 306 has a second end 316 defining an outlet 318 of the passageway 308. The tubular wall 306 includes an interior surface 320 facing the axis 310 that defines the passageway 308. The interior surface 320 has a radius 322 from the axis 310. The radius 322 of the interior surface 320 from the axis 310 decreases as a function of position from the first end 312 to the second end 316. In other words, the radius 322 of the interior surface 320 is greatest at the inlet 314 and is least at the outlet 318 of the passageway 308. The tubular wall 306 can include an outer surface 324. In embodiments, the outer surface 324 is parallel to the axis 310 or approximately parallel to the axis 310 (i.e., forming an angle of −10 degrees to 10 degrees relative to the axis 310).

The base 300 further includes a lateral wall 326 that extends laterally outward from the tubular wall 306. That is, the lateral wall 326 extends away from the axis 310 in all radial directions from the tubular wall 306. The lateral wall 326 includes a top surface 328 and a bottom surface 330. Both the top surface 328 and the bottom surface 330 can be perpendicular to the axis 310 or approximately perpendicular to the axis 310 (i.e., forming an angle of 80 degrees to 100 degrees relative to the axis 310).

The base 300 further includes an outer wall 332. The outer wall 332 extends upward from the lateral wall 326 and forms a perimeter around the top surface 238 of the lateral wall 326. The outer wall 332 is present in all radial directions around the axis 310. The outer wall 332 includes an inner surface 334 that faces the axis 310. In embodiments, the inner surface 334 is parallel to the axis 310 or approximately parallel to the interface (i.e., forming an angle of −10 degrees to 10 degrees relative to the axis 310). The inner surface 334 has a radius 336 from the axis 310. The outer wall 332 has a top 338, which is the portion of the outer wall 332 most elevated from the top surface 328 of the lateral wall 326. The top 338 of the outer wall 332 is more elevated from the top surface 328 of the lateral wall 326 than the second end 316 of the tubular wall 306.

Figure 18:
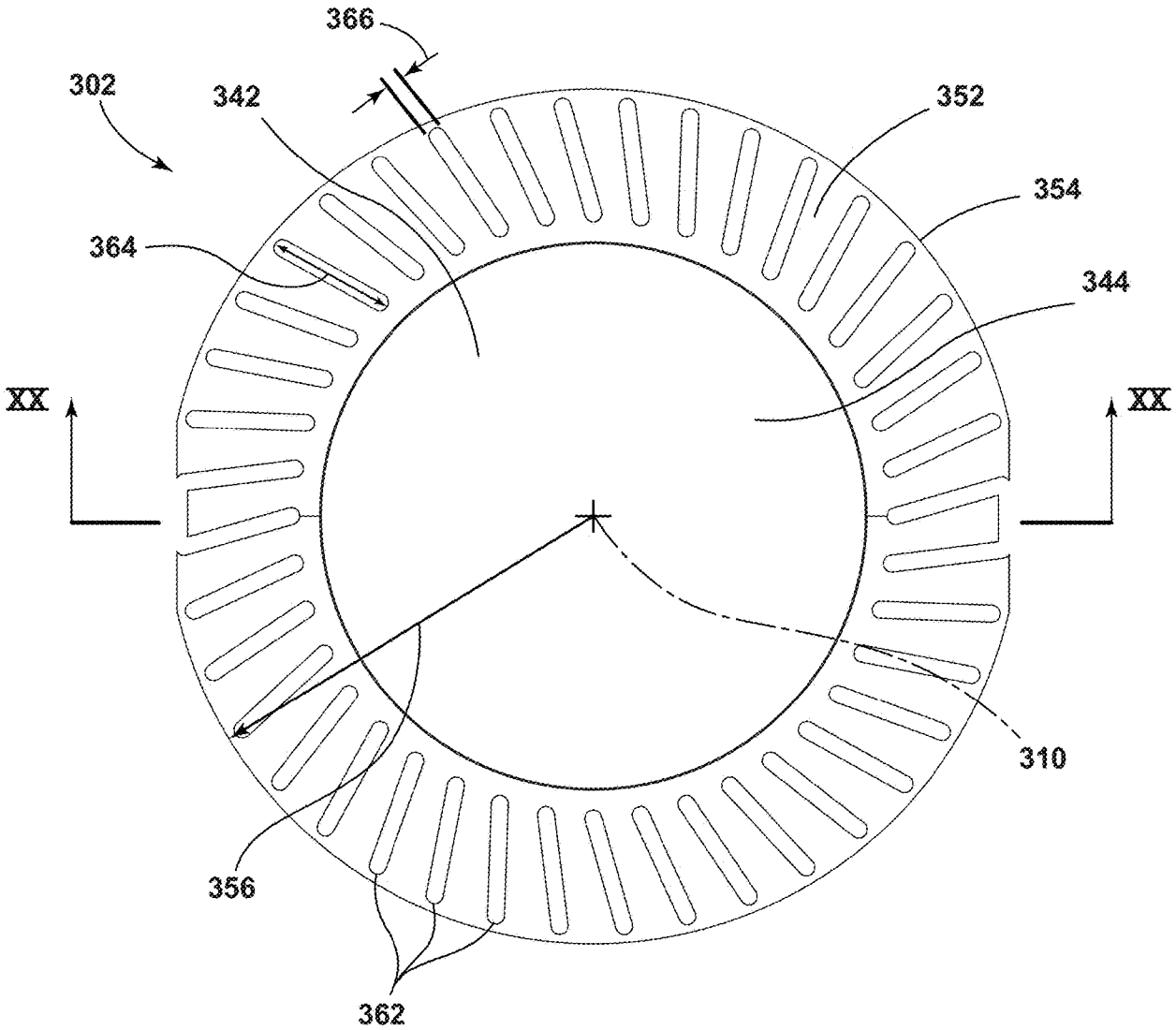
FIG. 18 is a top view of the spreader of the burner assembly of FIG. 14, illustrating a central portion radially around the axis, an outer portion radially around the central portion, and the plurality of apertures extending though the spreader at the outer portion.
Figure 19:
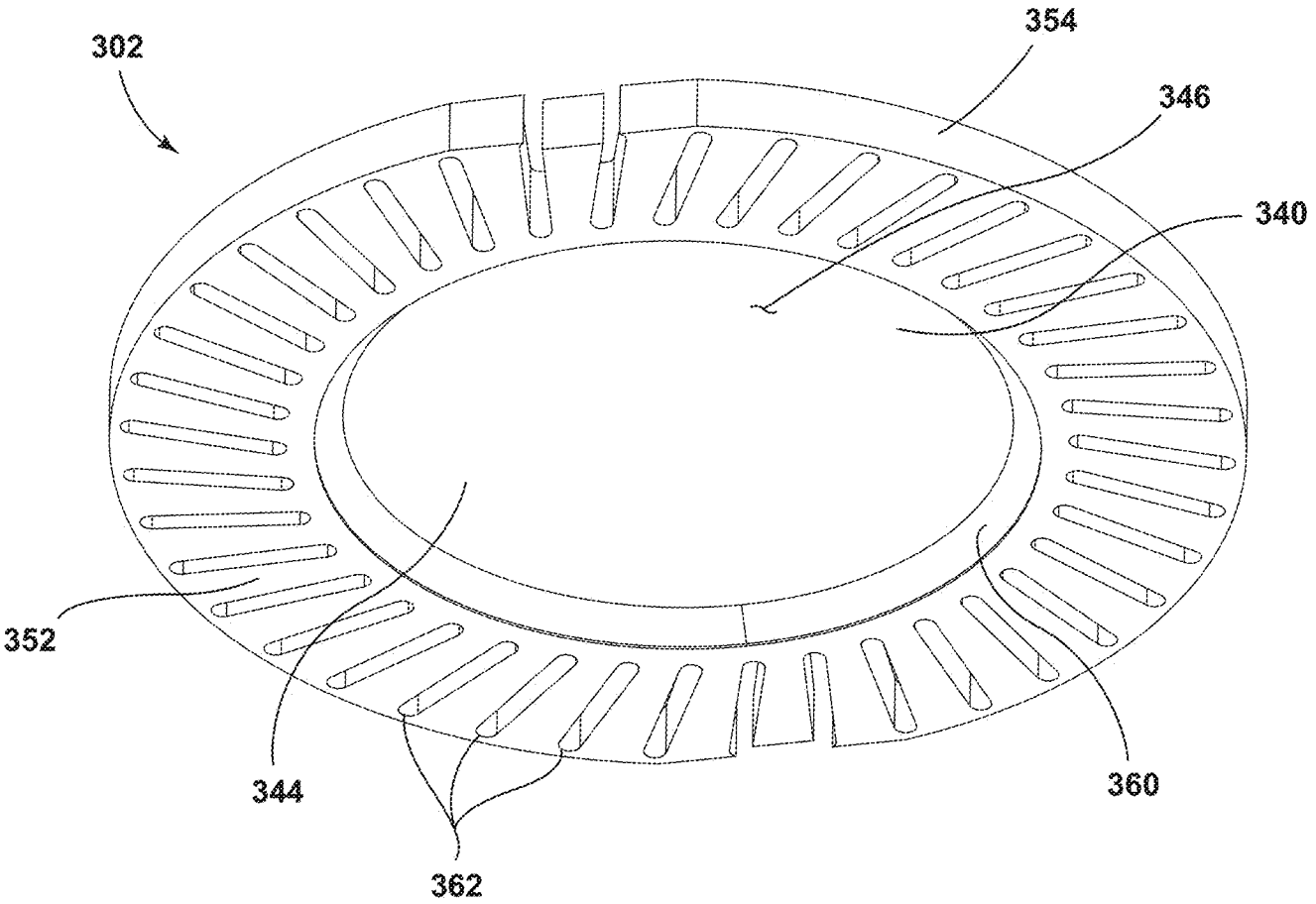
FIG. 19 is a bottom perspective view of the spreader of the burner assembly of FIG. 14, illustrating a sloped surface at the bottom radially around the axis disposed closer to the axis than the plurality of apertures of the spreader.
Figure 20:
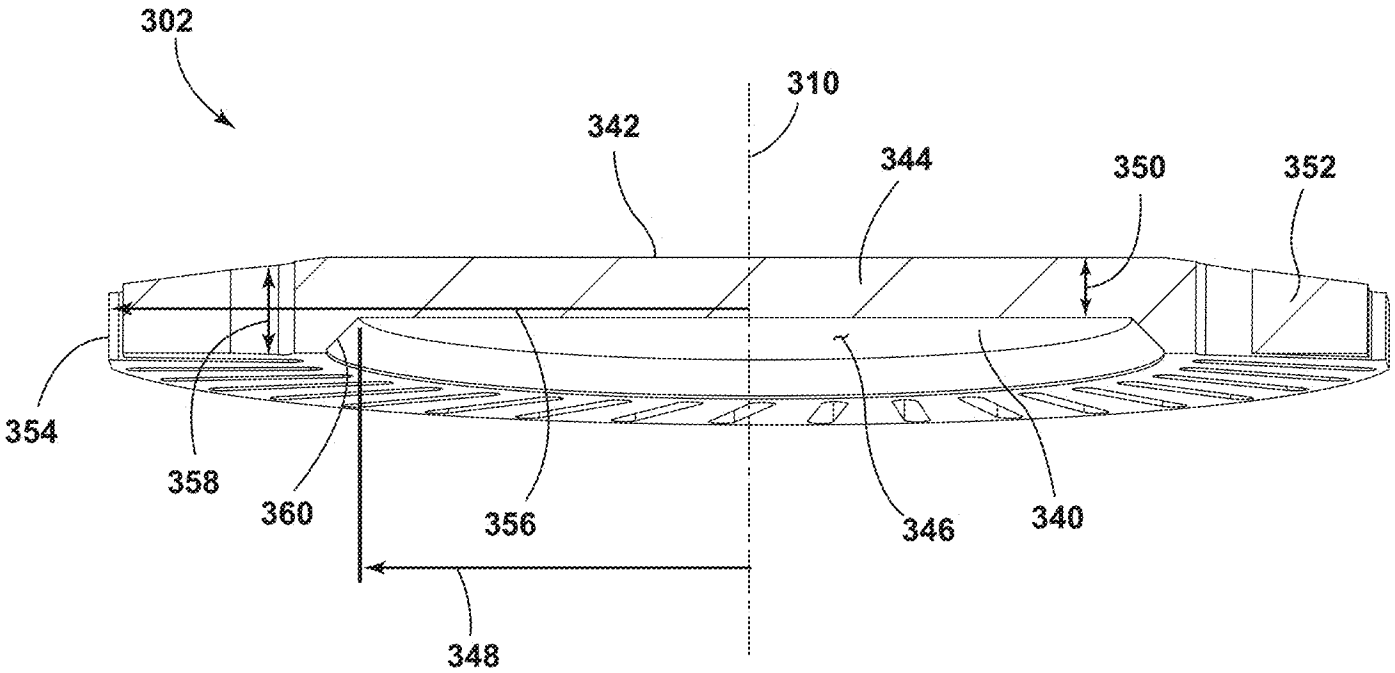
FIG. 20 is an elevation cross-sectional view of the spreader of the burner assembly of FIG. 14, illustrating the central portion having a thickness that is less than a thickness of the outer portion.

As mentioned, the burner assembly 12A further includes the spreader 302 (see particularly FIGS. 18-20). The spreader 302 is disposed above the tubular wall 306 and the lateral wall 326 of the base 300. The spreader 302 includes a bottom 340 and a top 342 and has a disc-like shape. The bottom 340 faces toward the base 300. The spreader 302 includes a central portion 344 through which the axis 310 extends. The central portion 344 surrounds the axis 310. The central portion 344 is disposed above the outlet 318 of the passageway 308 of the base 300. The central portion 344 has a bottom surface 346 at the bottom 340. In embodiments, the bottom surface 346 of the central portion 344 is perpendicular to the axis 310 or is approximately perpendicular to the axis 310 (i.e., forming an angle of 80 degrees to 100 degrees relative to the axis 310). The bottom surface 346 extends a radius 348 from the axis 310, and the radius 348 is greater than the radius 322 of the interior surface 320 of the passageway 308 of the base 300 at the outlet 318 of the passageway 308. The central portion 344 has a thickness 350.

The spreader 302 further includes an outer portion 352 surrounding the central portion 344. The outer portion 352 is further away from the axis 310 than the central portion 344. The outer portion 352 terminates in an edge 354 that defines a lateral perimeter of the spreader 302 away from the axis 310. The edge 354 is at a radius 356 from the axis 310. The radius 356 of the edge 354 is equal to or less than the radius 336 of the inner surface 334 of the outer wall 332 of the base 300. The outer portion 352 has a thickness 358. In embodiments, the thickness 358 decreases as a function of increasing distance from the axis 310. The thickness 358 of the outer portion 352 is greater than the thickness 350 of the central portion 344. A sloped surface 360 transitions between the central portion 344 and the outer portion 352 at the bottom 340 of the spreader 302. The sloped surface 360 forms an acute angle relative to the axis 310 (e.g., 35 degrees to 55 degrees). The sloped surface 360 is radial about the axis 310.

The spreader 302 further includes a plurality of apertures 362. The plurality of apertures 362 extends through the thickness 358 of the outer portion 352 and are open at the top 342 and the bottom 340 of the spreader 302. In embodiments, the plurality of apertures 362 have a slot-like appearance, with a length 364 along a plane perpendicular to the axis 310 that is more than 3 times greater than a width 366 along the plane. In embodiments, a straight-light coincident with the length 364 of the plurality of apertures 362 does not intersect the axis 310.

The spreader 302 sits within the base 300. The outer wall 332 of the base 300 surrounds the edge 354 of the outer portion 352 of the spreader 302, with the inner surface 334 of the outer wall 332 of the base 300 facing the edge 354 of the spreader 302. The bottom surface 346 of the central portion 344 of the spreader 302 is separated from the second end 316 of the tubular wall 306 of the base 300.

Figure 21:
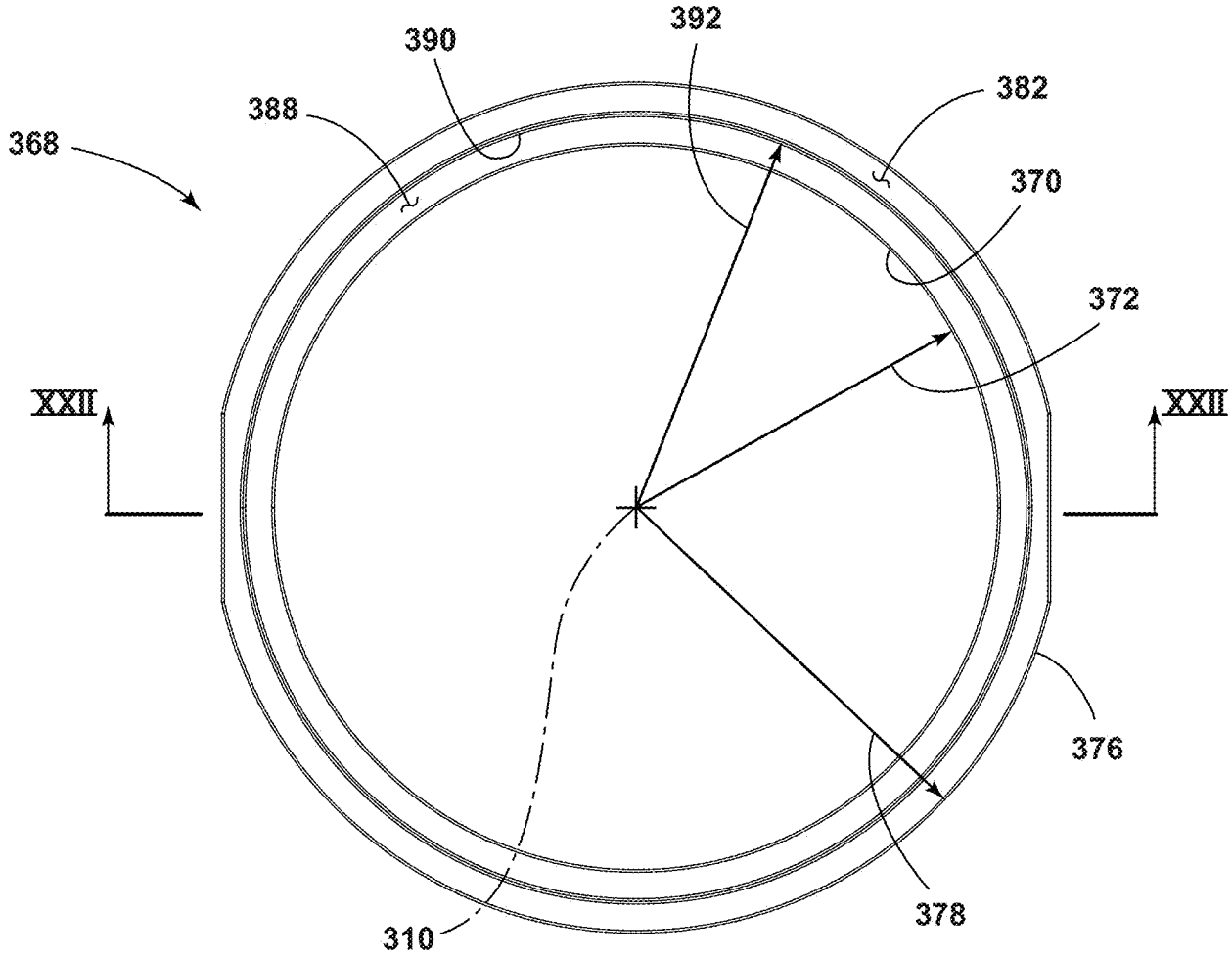
FIG. 21 is a top view of a platform of the burner assembly of FIG. 14, illustrating that the platform has a ring shape, purposes of the platform being to raise the perforated sheet above the tubular wall of the base and to raise the spreader above the perforated sheet.
Figure 22:
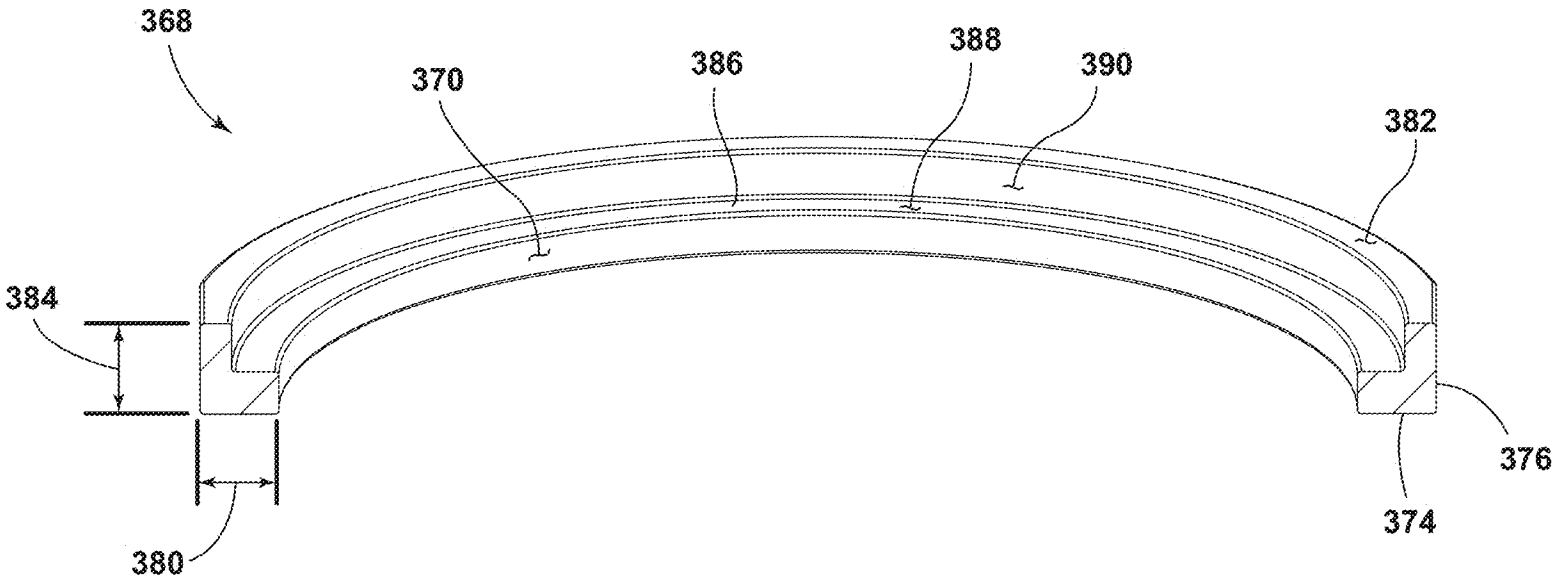
FIG. 22 is a perspective cross-sectional view of the platform of the burner assembly of FIG. 14, illustrating a ledge recessed into the platform and the ledge extending radially around the axis, a purpose of the ledge being to support the perforated sheet.

In embodiments, the burner assembly 12A further includes a platform 368 for the spreader 302 within the base 300 (see particularly FIGS. 21 and 22). The platform 368 elevates the bottom surface 346 of the central portion 344 of the spreader 302 above the second end 316 of the tubular wall 306 of the base 300. In embodiments (as in the illustrated embodiments), the platform 368 is a ring through which the axis 310 extends. The platform 368 includes an inside surface 370 that is closest to the axis 310, and has a radius 372 from the axis 310. The platform 368 further includes a bottom surface 374. The bottom surface 374 is perpendicular to the axis 310, or approximately perpendicular to the axis 310 (i.e., forming an angle of 80 degrees to 100 degrees relative to the axis 310). The bottom surface 374 of the platform 368 sits upon the top surface 328 of the lateral wall 326 of the base 300. The tubular wall 306 of the base 300 extends up through platform 368 with the inside surface 370 of the platform 368 facing the outer surface 324 of the tubular wall 306 of the base 300 above the lateral wall 326 of the base 300. The platform 368 further includes an outer surface 376. The outer surface 376 has a radius 378 from the axis 310, and the radius 378 is greater than the radius 372 of the inside surface 370. Both the inside surface 370 and the outer surface 376 can be parallel to the axis 310 or approximately parallel to the axis 310 (i.e., forming an angle of −10 degrees to 10 degrees relative to the axis 310). The inner surface 334 of the base 300 faces and is adjacent to the outer surface 376 of the platform 368. The platform 368 has a thickness 380 between the inside surface 370 and the outer surface 376 of the platform 368, and the thickness 380 is less than the radius 372 of the inner surface from the axis 310.

The platform 368 further includes a top surface 382. In embodiments, the top surface 382 is parallel to the bottom surface 374. In embodiments, the top surface 382 is perpendicular to the axis 310, or approximately perpendicular to the axis 310 (i.e., forming an angle of 80 degrees to 100 degrees relative to the axis 310). The bottom 340 of the spreader 302 at the outer portion 352 of the spreader 302 sits upon the top surface 382 of the platform 368. The platform 368 has a height 384, which is the distance between the top surface 382 and the bottom surface 374 of the platform 368. The height 384 of the platform 368 thus elevates the bottom 340 of the spreader 302 from the top surface 328 of the lateral wall 326 of the base 300, which separates the bottom surface 346 of the central portion 344 of the spreader 302 from the outlet 318 of the passageway 308 of the base 300.

In embodiments, the platform 368 includes a ledge 386 inset into the platform 368. The ledge 386 includes a surface 388 that is perpendicular to the axis 310 or approximately perpendicular to the axis 310 (i.e., forming an angle of 80 degrees to 100 degrees relative to the axis 310). The surface 388 can be approximately half-way up the height 384 from the bottom surface 374 of the platform 368.

The ledge 386 further includes a surface 390 that is parallel to the axis 310 or approximately parallel to the axis 310 (i.e., forming an angle of −10 degrees to 10 degrees relative to the axis 310). The surface 390 has a radius 392 from the axis 310. The radius 392 of the surface 390 of the ledge 386 is greater than the radius 372 of the inside surface 370 but less than the radius 378 of the outer surface 376.

In other embodiments of the burner assembly 12A, there is no platform 368 that is separate from the base 300, and the base 300 provides the top surface 382 at the height 384 and the ledge 386 with the surface 388 less elevated from the top surface 328 of the lateral wall 326 of the base 300 than the top surface 382.

Figure 23:
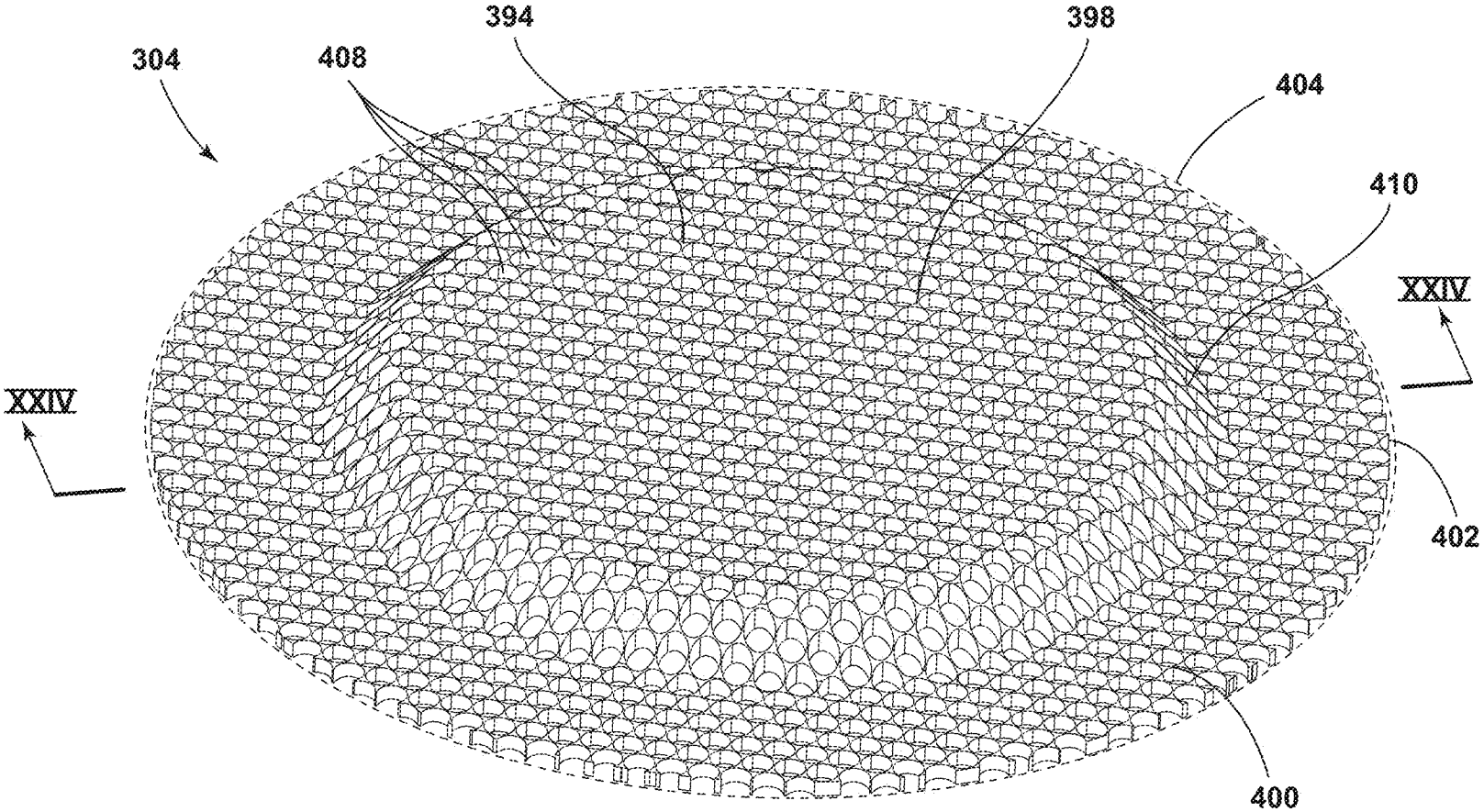
FIG. 23 is a perspective view of the perforated sheet of the burner assembly of FIG. 14, illustrating an edge of the perforated sheet fitting within an area.
Figure 24:
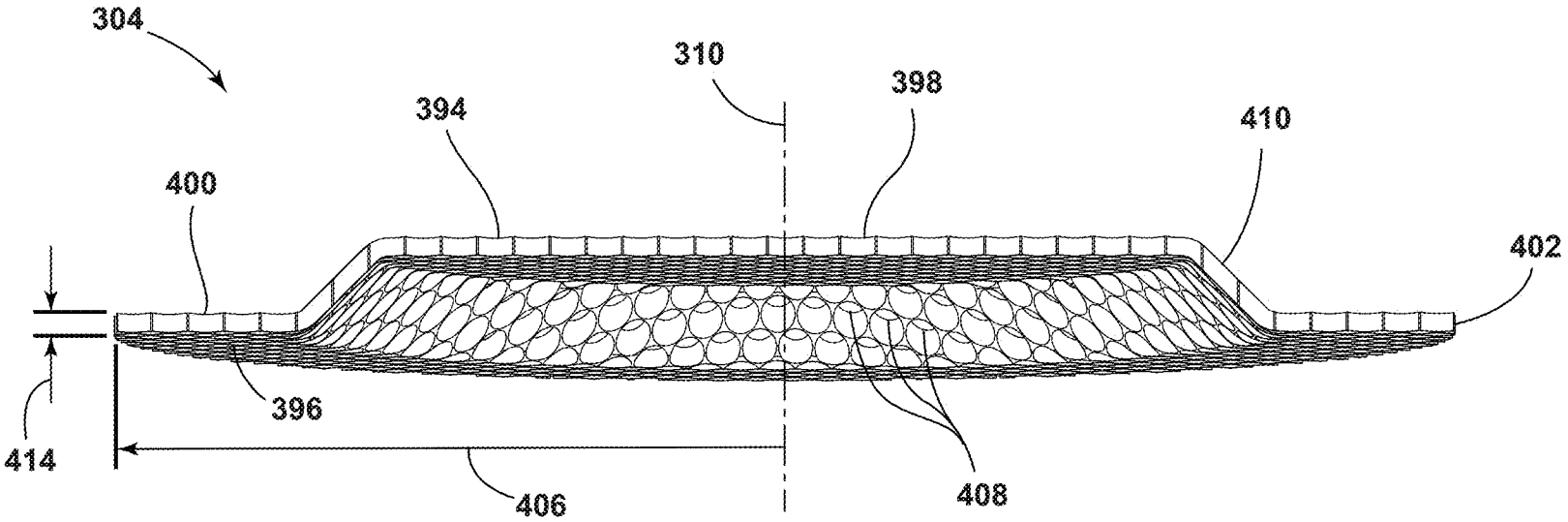
FIG. 24 is an elevation view of a cross-section of the perforated sheet of the burner assembly of FIG. 14 taken through line XXIV-XXIV of FIG. 23, illustrating a central portion radially around the axis, an outer portion radially around the axis further from the axis than the central portion and terminating at the edge, and a sloped portion radially around the axis disposed between the central portion and the outer portion elevating the central portion above the outer portion.
Figure 25:
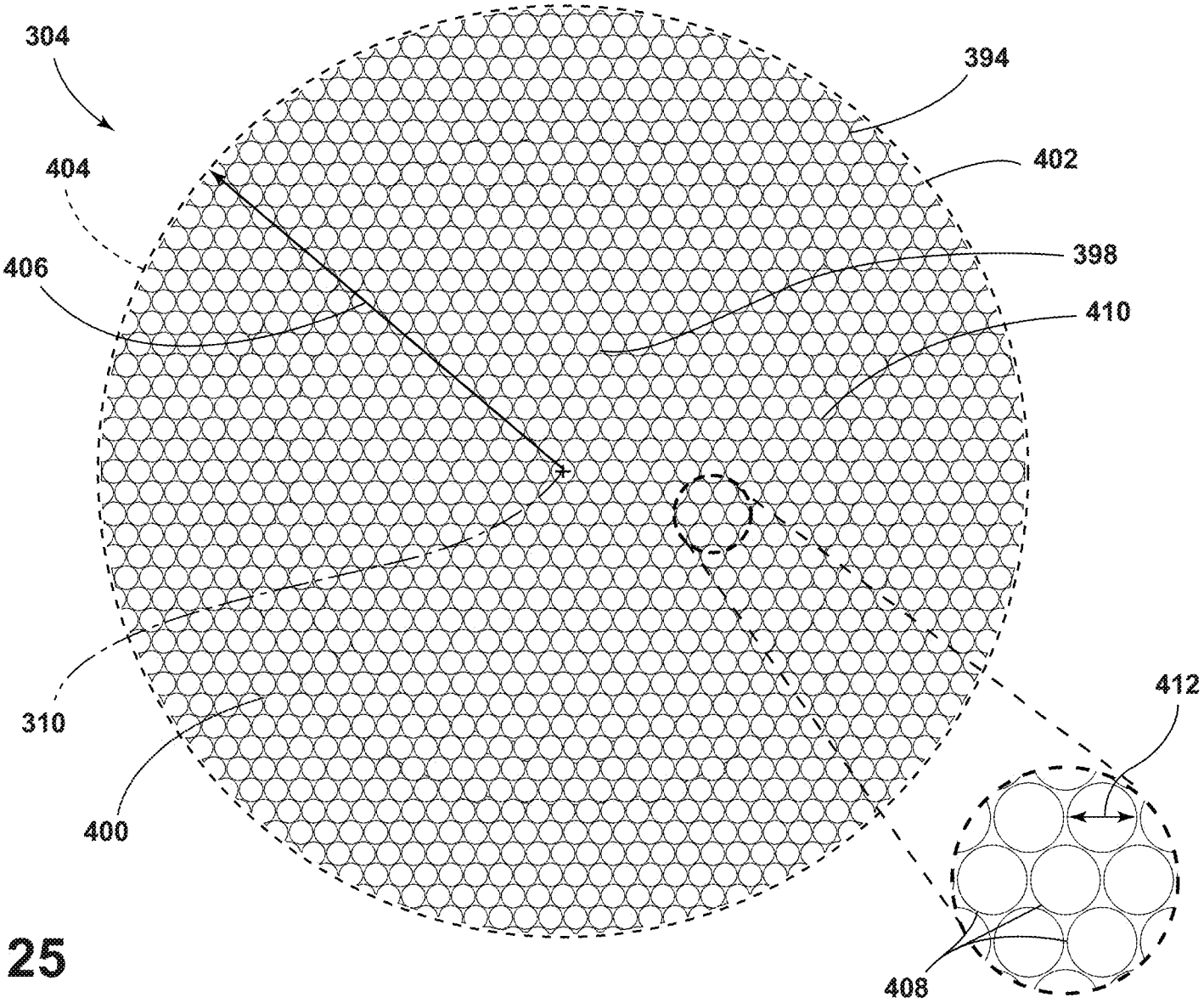
FIG. 25 is a top view of the perforated sheet of the burner assembly of FIG. 14, illustrating each of the plurality of apertures having a diameter.

As mentioned, the burner assembly 12A further includes the perforated sheet 304 (see particularly FIGS. 23-25). The perforated sheet 304 is disposed between the base 300 and the spreader 302, and the axis 310 extends through the perforated sheet 304. The perforated sheet 304 includes a top 394 and a bottom 396. The bottom 396 of the perforated sheet 304 faces the top surface 328 of the lateral wall 326 of the base 300 and the second end 316 of the tubular wall 306 of the base 300. The top 394 of the perforated sheet 304 faces the bottom 340 of the spreader 302.

The perforated sheet 304 includes a central portion 398, through the axis 310 extends. The central portion 398 of the perforated sheet 304 is disposed between the central portion 344 of the spreader 302 and the tubular wall 306 of the base 300, including the second end 316 of the tubular wall 306. In embodiments, the central portion 398 is separated from the second end 316 of the tubular wall 306 and separated from the bottom surface 346 of the central portion 344 of the spreader 302.

The perforated sheet 304 further includes an outer portion 400. The outer portion 400 is further away from the axis 310 than the central portion 398. The outer portion 400 terminates in an edge 402 of the perforated sheet 304. The edge 402 fits within an area 404 that is perpendicular to the axis 310, and the area 404 has a distance 406 from the axis 310. The distance 406 of the area 404 is less than the radius 336 of the inner surface 334 of the outer wall 332 of the base 300. The inner surface 334 of the outer wall 332 of the base 300 surrounds edge 402 of the perforated sheet 304. The distance 406 of the area 404 is greater than the radius 372 of the inside surface 370 of the platform 368 (or, in embodiments, the base 300). The outer portion 400 of the perforated sheet 304 is disposed between the lateral wall 326 of the base 300 and the outer portion 352 of the spreader 302, including between the lateral wall 326 of the base 300 and the plurality of apertures 362 of the spreader 302.

The perforated sheet 304 further includes a plurality of apertures 408. The plurality of apertures 408 extends through the perforated sheet 304 and are open at the top 394 and the bottom 396 of the perforated sheet 304.

In embodiments of the burner assembly 12A that include the platform 368, the perforated sheet 304 sits upon the platform 368. In any event, the bottom 396 of the perforated sheet 304 at the edge 402 sits upon the surface 388, either of the ledge 386 of the platform 368 or provided directly by the base 300. The surface 390 of the ledge 386 of the platform 368 (or provided directly by the base 300) faces the edge 402 of the perforated sheet 304.

In embodiments, the perforated sheet 304 can include a sloped portion 410 between the central portion 398 and the outer portion 400. The sloped portion 410 elevates the central portion 398 higher up the axis 310 than the outer portion 400. The central portion 398 is thus separated from the tubular wall 306 of the base 300, i.e., elevated off the second end 316 of the tubular wall 306. In embodiments, the top surface 382 upon which the spreader 302 sits is spaced sufficiently from the surface 388 of the ledge 386 upon which the perforated sheet 304 sits so that the outer portion 352 of spreader 302 is separated from the outer portion 400 of the perforated sheet 304.

In embodiments, the perforated sheet 304 comprises metal. The perforated sheet 304 can be formed from a piece of metal such as steel and machined to be perforated with the plurality of apertures 408. In embodiments, each of the plurality of apertures 408 has a diameter 412 of 1.9 mm to 2.1 mm. The perforated sheet 304 has a thickness 414, which is the shortest straight-line distance between the bottom 396 and the top 394. In embodiments, the thickness 414 of the perforated sheet 304 is 0.8 mm to 1.0 mm. In embodiments, the plurality of apertures 408 comprises 40 percent to 60 percent of the area 404 within which the edge 402 fits. In embodiments, the plurality of apertures 408 comprises 50 percent to 55 percent of the area 404 within which the edge 402 fits, such as approximately 51 percent.

Figure 15:
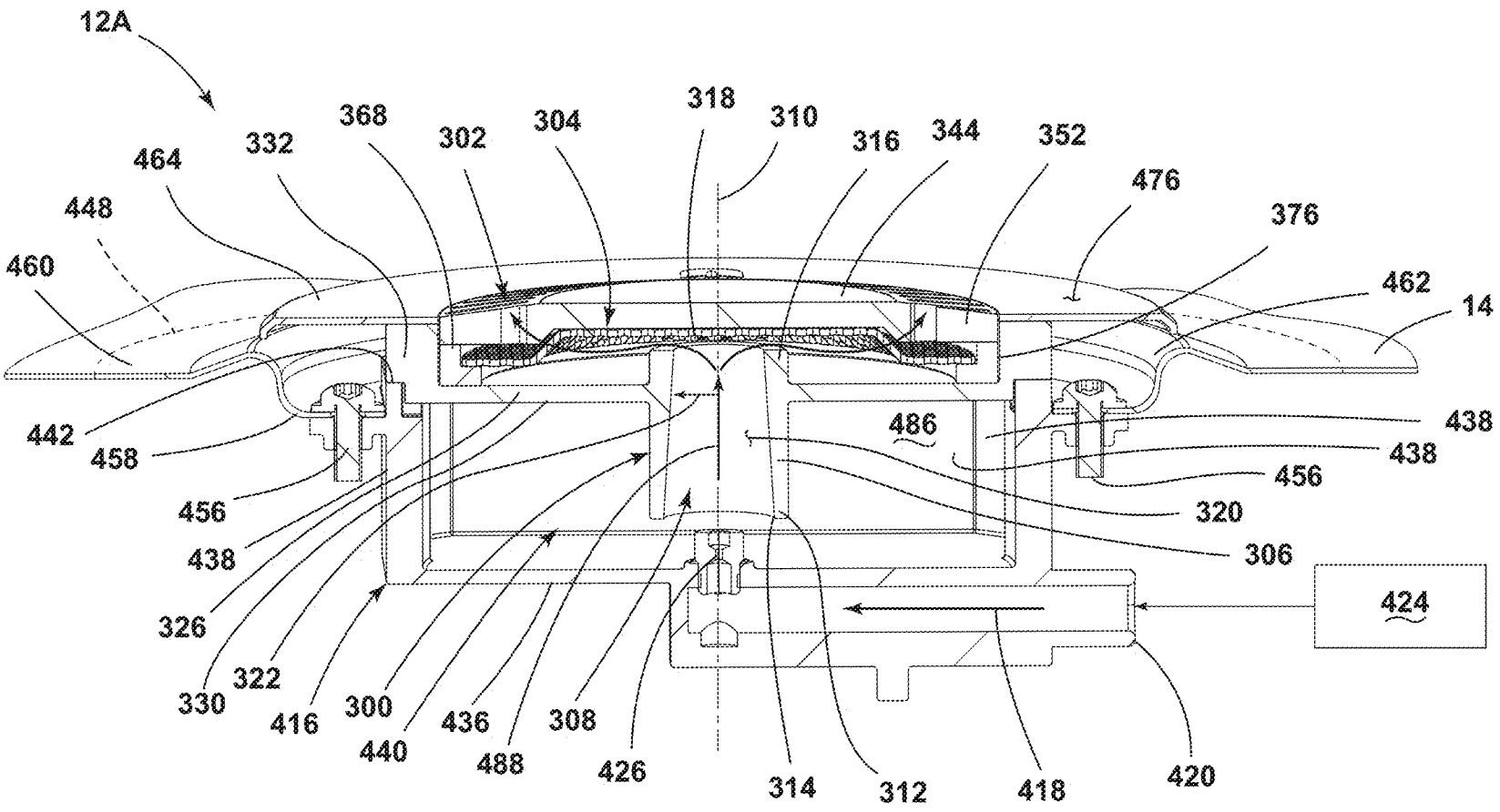
FIG. 15 is an elevation cross-sectional view of the burner assembly of FIG. 14, illustrating a perforated sheet disposed between the spreader and a base that delivers a mixture of air and gaseous fuel through a passageway to a bottom of the spreader, which forces the mixture radially outward from an axis and then upward through the plurality of apertures of the spreader, and the mixture flows through a plurality of apertures of the perforated sheet between the passageway and plurality of apertures of the spreader.
Figure 26:
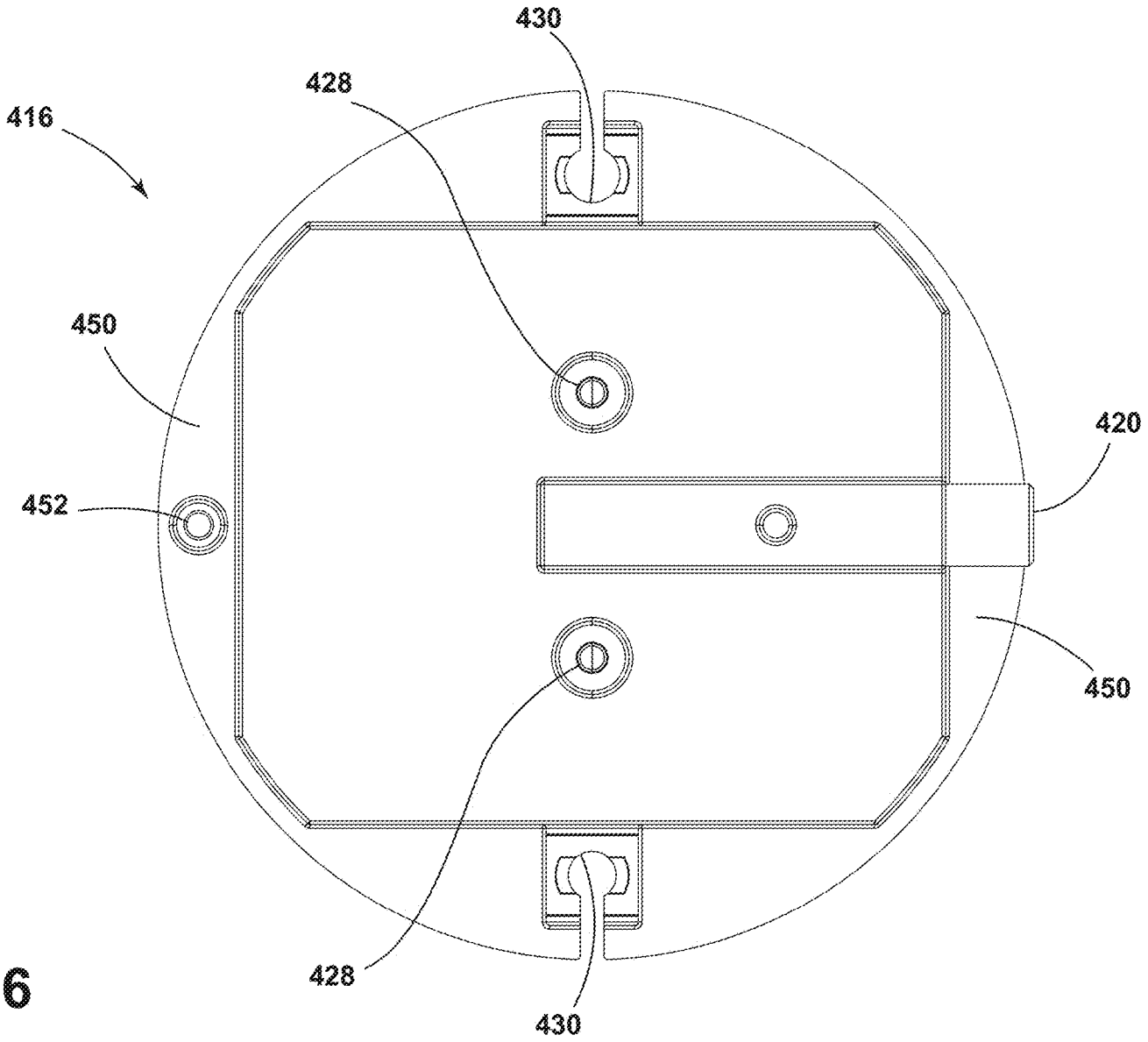
FIG. 26 is a bottom view of a bottom housing of the burner assembly of FIG. 14, illustrating an inlet to receive gaseous fuel.
Figure 27:
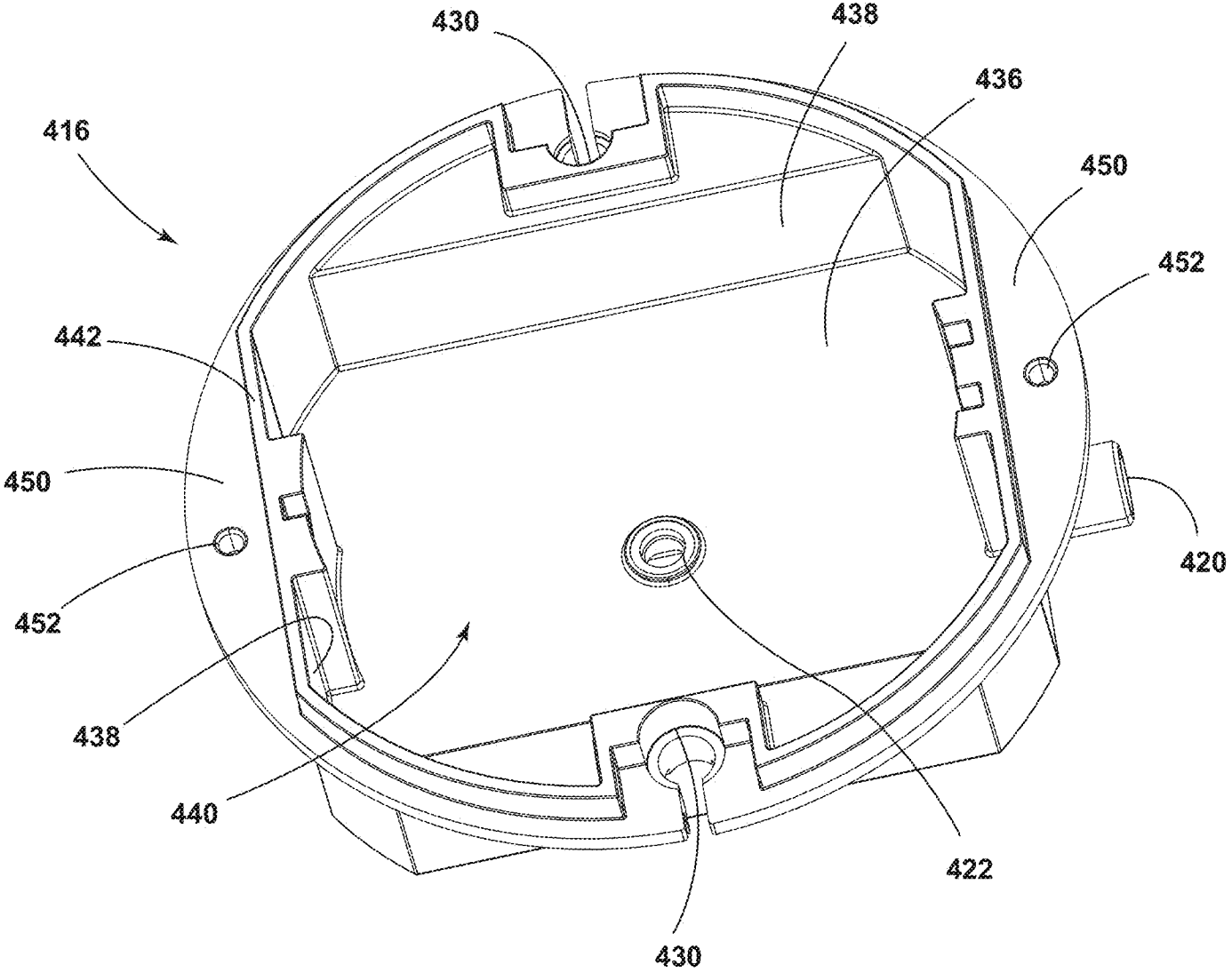
FIG. 27 is a top perspective view of the bottom housing of the burner assembly of FIG. 14, illustrating a bottom wall and side walls extending upward from the bottom wall forming an interior chamber and an outlet for the gaseous fuel.
Figure 28:
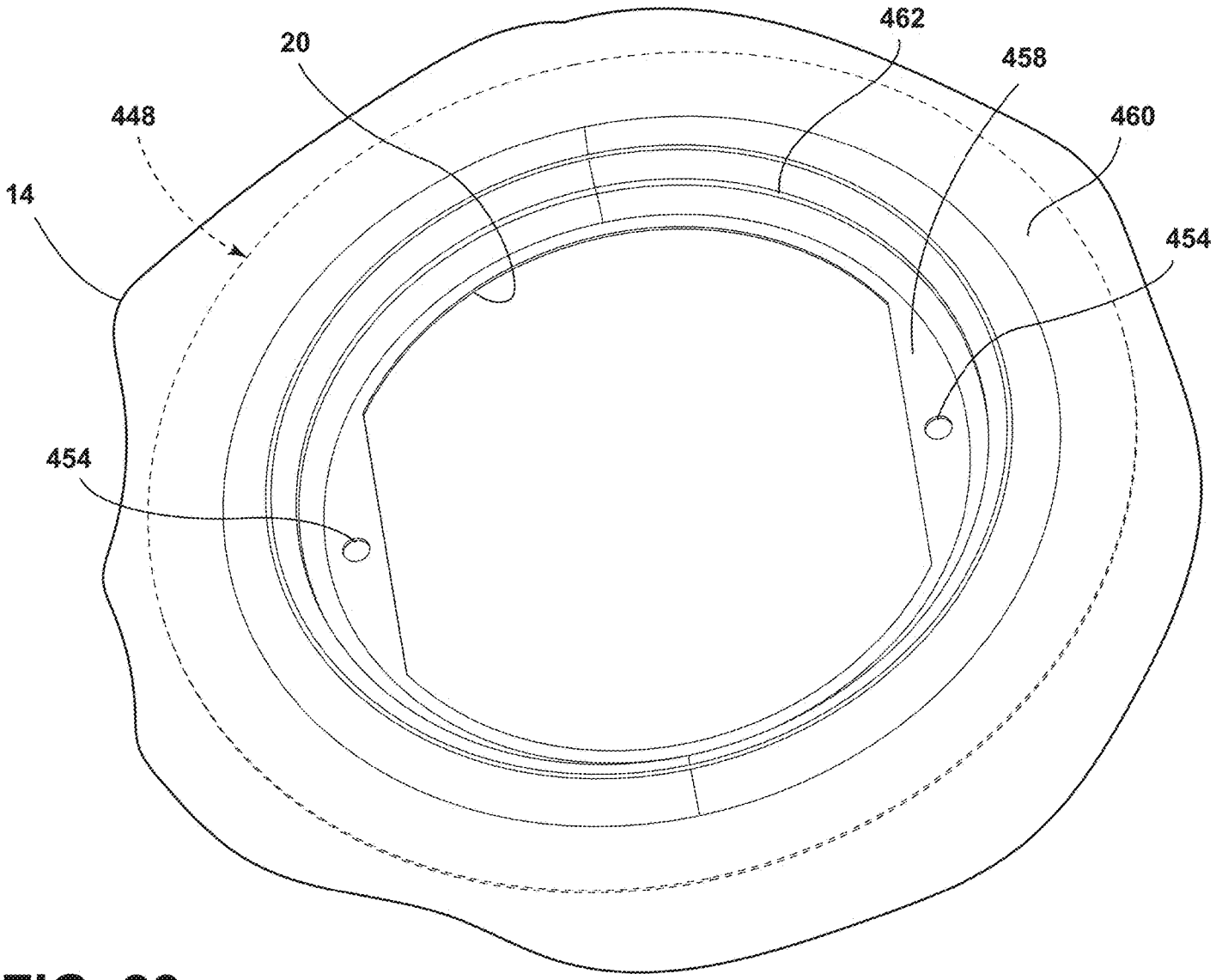
FIG. 28 is a top perspective view of a trim ring portion of the top wall of the cooktop of FIGS. 1A and 1B for use with the burner assembly of FIG. 14, illustrating an inner portion, an outer portion radially around the axis further away from the axis than the inner portion, and a middle portion radially around the axis between the inner portion and the outer portion.

In embodiments, the burner assembly 12A includes a bottom housing 416 (see particularly FIGS. 15, 26, and 27). The bottom housing 416 includes a passageway 418, with an inlet 420 into the passageway 418, and an outlet 422 out of the passageway 418. The inlet 420 is in fluid communication with gaseous fuel 424. The outlet 422 is coupled to an injector 426. The bottom housing 416 can include receivers 428 to receive fasteners (not illustrated) to fasten the bottom housing 416 to the bottom 32 of the cooktop 10. In embodiments, the burner assembly 12A further includes slots 430. The slots 430 hold an ignition electrode 432 and a temperature sensor 434, respectively.

In embodiments, the bottom housing 416 includes a bottom wall 436 and one or more side walls 438 extending upward from the bottom wall 436 and thus forming a perimeter around the bottom wall 436 thus forming an interior chamber 440. The one or more side walls 438 include a top 442. The base 300 is disposed over the bottom housing 416 with the outer wall 332 of the base 300 sitting upon the top 442 of the one or more side walls 438. The ignition electrode 432 and the temperature sensor 434 extend upward through apertures 444, 446, respectively, through the base 300. The outlet 422 of the passageway 418 is open to the interior chamber 440. The axis 310 extends into the outlet 422. The tubular wall 306 of the base 300 extends into the interior chamber 440 of the bottom housing 416. The first end 312 and inlet 314 of the tubular wall 306 are disposed above the injector 426. The first end 312 and the inlet 314 are separated from the bottom wall 436 of the bottom housing 416.

In embodiments, the top wall 14 of the cooktop 10 further includes a trim ring portion 448 (see particularly FIGS. 14, 15, and 28) for use with the burner assembly 12A. The trim ring portion 448 includes the aperture 20 through which the burner assembly 12A extends, with the bottom housing 416 above the bottom 32 of the cooktop 10. The axis 310 extends through the trim ring portion 448. The bottom housing 416 can include lateral wings 450 extending laterally outward from the one or more side 438 walls, and apertures 452 into or though the lateral wings 450. The trim ring portion 448 includes apertures 454 that cooperate with the apertures 452 of the bottom housing 416, which permit fasteners 456 to attach bottom housing 416 to the trim ring portion 448 of the top wall 14 of the cooktop 10. The apertures 454 are disposed at an inner portion 458 of the trim ring portion 448. The inner portion 458 can be perpendicular to the axis 310 or approximately perpendicular to the axis 310 (i.e., forming an angle of 80 degrees to 100 degrees relative to the axis 310). The trim ring portion 448 further includes an outer portion 460 surrounding the inner portion 458. The outer portion 460 is elevated higher than the inner portion 458. The outer portion 460 can be perpendicular to the axis 310 or approximately perpendicular to the axis 310 (i.e., forming an angle of 80 degrees to 100 degrees relative to the axis 310). The outer portion 460 can be perpendicular to the axis 310 or approximately perpendicular to the axis 310 (i.e., forming an angle of 80 degrees to 100 degrees relative to the axis 310). The trim ring portion 448 further includes a middle portion 462 that transitions between the outer portion 460 and the inner portion 458, and lowers the inner portion 458 below the outer portion 460. The outer portion 460 of the trim ring portion 448 extends further away from the axis 310 than the outer wall 332 of the base 300 and the outer portion 352 of the spreader 302.

Figure 14:
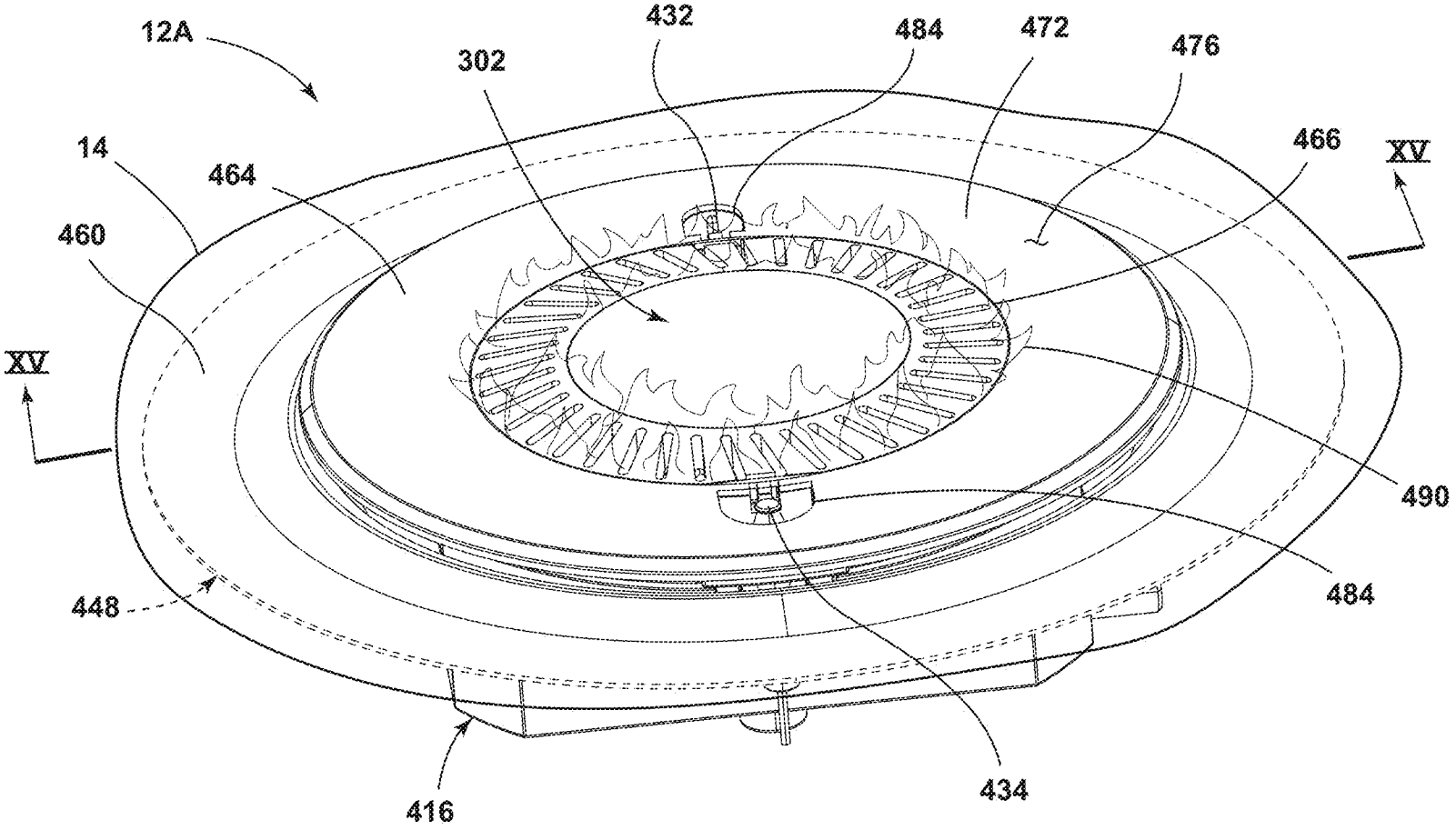
FIG. 14 is a perspective view of another embodiment burner assembly for use with the cooktop of FIGS. 1A and 1B, illustrating a flame above a plurality of apertures of a spreader.
Figure 29:
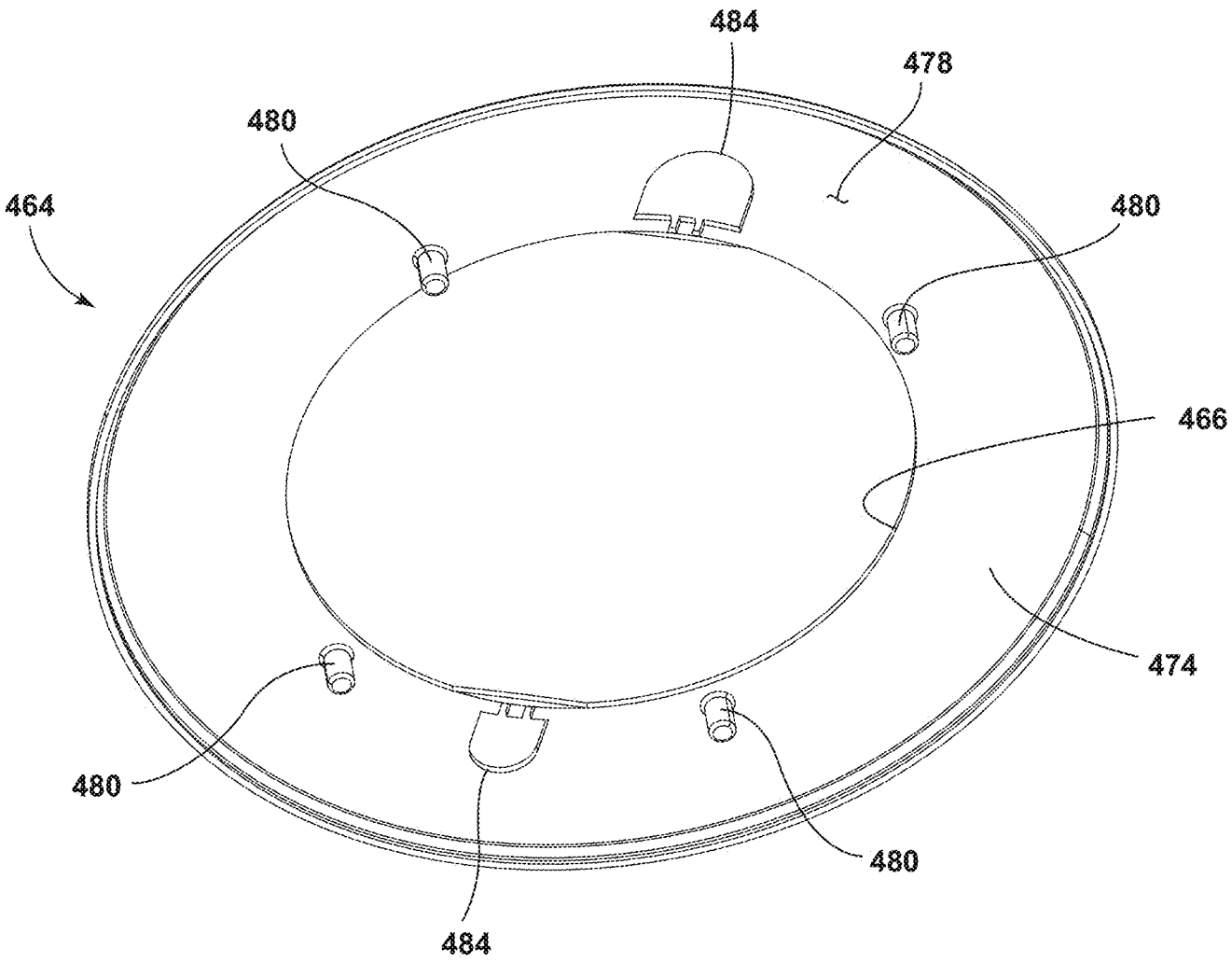
FIG. 29 is a bottom perspective view of a top skirt of the burner assembly of FIG. 14, illustrating a central aperture.
Figure 30:
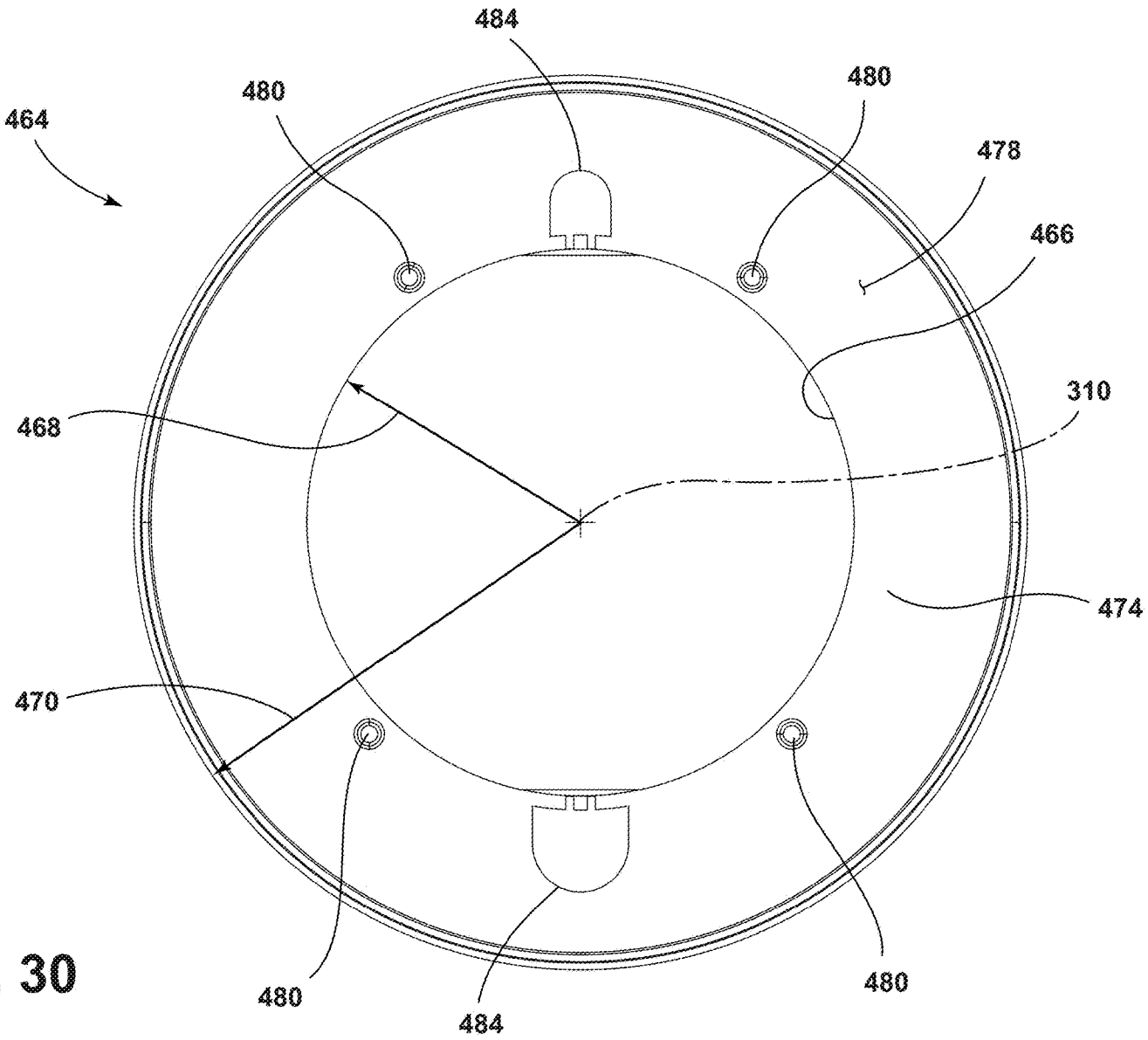
FIG. 30 is a bottom view of the top skirt of the burner assembly of FIG. 14.

In embodiments, the burner assembly 12A further includes a top skirt 464 (see particularly FIGS. 14, 29, and 30). The top skirt 464 has a central aperture 466, through which the axis 310 extends. The top skirt 464 has an inner radius 468 from the axis 310 and terminates at an outer radius 470. The inner radius 468 of the top skirt 464 is greater than or equal to the radius 456 of the edge 354 of the spreader 302. The top skirt 464 includes a top 472 and a bottom 474. The top 472 of the top skirt 464 includes a surface 476 that is perpendicular to the axis 310 or approximately perpendicular to the axis 310 (i.e., forming an angle of 80 degrees to 100 degrees relative to the axis 310). The surface 476 extends most of the way between the inner radius 468 and the outer radius 470.

The top skirt 464 is disposed over the outer wall 332 of the base 300 and the inner portion 458 of the trim ring portion 448. The bottom 474 of the top skirt 464 includes a surface 478 that is perpendicular to the axis 310 or approximately perpendicular to the axis 310 (i.e., forming an angle of 80 degrees to 100 degrees relative to the axis 310). The surface 478 extends most of the way between the inner radius 468 and the outer radius 470. The surface 478 is disposed over the top 338 of the outer wall 332 of the base 300. The top skirt 464 includes projections 480 at the bottom 474 that extend away from the surface 478. The projections 480 are disposed within receivers 482 into the top 338 of the outer wall 332 of the base 300 to limit lateral movement of the top skirt 464. The top skirt 464 further includes apertures 484 through which the temperature sensor 434 and the ignition electrode 432 protrude.

In use, gaseous fuel 424 enters into the inlet 420 of the passageway 418 of the bottom housing 416. The gaseous fuel 424 flows through the passageway 418 to the injector 426. The injector 426 injects the gaseous fuel 424 through the inlet 420 and into the passageway 308 of the base 300 in a direction parallel to the axis 310. The gaseous fuel 424 pulls air 486 from the interior chamber 440 into the passageway 308 of the base 300 as well, thus forming a mixture of air and gaseous fuel 488. The mixture of air and gaseous fuel 488 exits the outlet 318 of the passageway 308 of the base 300. The bottom surface 346 of the central portion 344 of the spreader 302 pushes the mixture of air and gaseous fuel 488 laterally outward from the axis 310, through the plurality of apertures 408 of the perforated sheet 304, and then through the plurality of apertures 362 of the spreader 302. Assuming that the mixture of air and gaseous fuel 488 is combusted, then the mixture of air and gaseous fuel 488 produces a flame 490 above the spreader 302.

The perforated sheet 304 prevents or reduces flashback of the flame 490 beyond the perforated sheet 304. The perforated sheet 304 quenches any such flame 490 attempting to flashback. Without flashback, the flame 490 is more stable. In addition, the perforated sheet 304 eliminates the need to manufacture a different spreader 302 for each of the different kinds of gaseous fuels (butane, methane, propane, etc.). Typically, to address flashback, the size and distribution of the plurality of apertures 362 of the spreader 302 are designed for a particular kind of gaseous fuel. The perforated sheet 304 eliminates any such desire to design and manufacture different spreaders for different types of gaseous fuel, thus reducing expense.

Positioning of the perforated sheet 304 between the spreader 302 and the outlet 318 of the passageway 308 of base 300 does not restrict the amount of the air 486 drawn in from the interior chamber 440 of the bottom housing 416 to create the mixture of air and gaseous fuel 488. The small thickness of the perforated sheet 304 allows the burner assembly 12A to maintain size specifications. The perforated sheet 304 limiting or eliminating the flashback thus limits or eliminates the audible noise that such flashback generates.

Further, the perforated sheet 304 reduces the velocity of the mixture of air and gaseous fuel 488, compared to if the perforated sheet 304 were not present. The reduction in the velocity of the mixture of air and gaseous fuel 488 reduces the likelihood of lifting of the flame 490 off the spreader 302. Thus, the perforated sheet 304 addresses that problem as well.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A burner assembly for a cooktop comprising:

a spreader comprising (i) a central portion through which an axis extends, the central portion having a bottom surface, (ii) a plurality of apertures through the spreader, the plurality of apertures disposed further away from the axis than the central portion, (iii) a ridge projecting from the bottom surface, the ridge disposed further from the axis than the central portion but closer to the axis than the plurality of apertures, and (iv) an outer portion that includes a lateral edge that defines an outermost perimeter of the spreader relative to the axis; and a burner cap disposed over the spreader, the burner cap comprising an outer portion comprising a flange that surrounds the lateral edge of the spreader.

2. The burner assembly of claim 1, wherein the ridge forms a contiguous perimeter around the bottom surface of the central portion.

3. The burner assembly of claim 1, wherein the ridge comprises an inner surface closest to the axis that forms an angle relative to the bottom surface of the central portion that is greater than 90 degrees and less than 120 degrees.

4. The burner assembly of claim 1, wherein the outer portion of the spreader is disposed further away from the axis than the plurality of apertures and the ridge; and the spreader further comprises (i) a plurality of spaced fingers, each separated by one of the plurality of apertures, bridging the central portion to the outer portion.

5. The burner assembly of claim 1 wherein, the burner cap further comprises (i) a central portion disposed over the central portion of the spreader, with the axis of the spreader extending through the central portion of the burner cap, (ii) a middle portion disposed further away from the axis than the central portion of the burner cap but closer to the axis than the outer portion of the burner cap, the middle portion disposed above the plurality of apertures of the spreader, and (iii) a plurality of apertures through the middle portion, wherein, the outer portion of the burner cap is disposed over the outer portion of the spreader, and wherein, the outer portion of the spreader is disposed further away from the axis than the plurality of apertures of the spreader and the ridge of the spreader.

6. The burner assembly of claim 1 further comprising:

a venturi comprising (i) an internal surface defining a passageway for a mixture of air and gaseous fuel, (i) an inlet into the passageway in communication with a source of air and a source of gaseous fuel and (ii) an outlet out of the passageway in fluid communication with the plurality of apertures of the spreader, wherein, the axis extending through the central portion of the spreader also extends into the outlet of the venturi.

7. The burner assembly of claim 6, wherein the ridge of the spreader comprises an inner surface that (i) forms an approximately right angle relative to the bottom surface of the central portion and (ii) is at least approximately parallel to the axis, the inner surface disposed at a radius from the axis;

the internal surface defining the passageway at the outlet has a radius from the axis; and the radius of the internal surface defining the outlet of the passageway is less than the radius of the inner surface of the ridge of the spreader.

8. The burner assembly of claim 6 further comprising:

a mixture of air and gaseous fuel flowing (i) through the passageway of the venturi toward the outlet of the venturi, (ii) out the outlet of the venturi, (iii) and through the plurality of apertures of the spreader, wherein, the ridge of the spreader reduces a velocity of the mixture of air and gaseous fuel before the mixture of air and gaseous fuel flows through the plurality of apertures of the spreader.

9. The burner assembly of claim 4 further comprising:

a venturi comprising (i) an internal surface defining a passageway for a mixture of air and gaseous fuel, (i) an inlet into the passageway in communication with a source of air and a source of gaseous fuel and (ii) an outlet out of the passageway in fluid communication with the plurality of apertures of the spreader, and a base disposed between the spreader and the venturi, the base comprising (i) a central aperture through which the axis that extends through the central portion of the spreader also extends, the central aperture in fluid communication with the passageway of the venturi, and (ii) an annular ridge at the top around and defining the central aperture, the annular ridge of the base disposed closer to the axis than the ridge projecting from the bottom surface of the spreader.

10. The burner assembly of claim 9 further comprising:

a mixture of air and gaseous fuel flowing (i) through the passageway of the venturi toward the outlet of the venturi, (ii) out the outlet of the venturi, (iii) through the central aperture of the base, (iv) between the annular ridge of the top of the base and the ridge projecting from the bottom surface of the spreader, and (v) through the plurality of apertures of the spreader, wherein, the ridge projecting from the bottom surface of the spreader reduces a velocity of the mixture of air and gaseous fuel before the mixture of air and gaseous fuel flows through the plurality of apertures of the spreader.

11. The burner assembly of claim 9, wherein the base further comprises an inner surface that defines the central aperture, the inner surface being parallel to the axis and having a radius from the axis;

the internal surface defining the passageway at the outlet has a radius from the axis; and the radius of the internal surface defining the passageway at the outlet is equal to the radius of the inner surface defining the central aperture of the base.

12. The burner assembly of claim 9, wherein the base further comprises a second annular ridge at the top of the base that surrounds the annular ridge and, with the annular ridge, defines an annular recess that is planar and perpendicular to the axis; and the spreader further comprises a second ridge at a bottom of the spreader that is further away from the axis than the ridge of the spreader, the second ridge disposed over the top of the base and facing the second annular ridge of the base, with the second ridge of the spreader being closer to the axis than the second annular ridge of the base.

13. The burner assembly of claim 1, wherein the spreader comprises a top surface, and the top surface at the central portion is elevated higher than the top surface at the outer portion.

14. A burner assembly for a cooktop comprising:

a base comprising (i) a tubular wall defining a passageway through which an axis extends, the tubular wall having a first end defining an inlet into the passageway and a second end defining an outlet of the passageway, (ii) a lateral wall extending laterally outward from the tubular wall, and (iii) an outer wall extending upward from the lateral wall and forming a perimeter around the lateral wall, the outer wall is more elevated from the lateral wall than the second end of the tubular wall;

a spreader disposed above the tubular wall and the lateral wall of the base, the spreader comprising (i) a central portion through which the axis extends, the central portion disposed above the outlet of the passageway of the base, (ii) an outer portion surrounding the central portion, the outer portion terminating in an edge that defines a lateral perimeter of the spreader away from the axis, with the outer wall of the base surrounding the edge of the outer portion of the spreader, and (iii) a plurality of apertures through the spreader at the outer portion; and a perforated sheet disposed between the base and the spreader, the perforated sheet comprising (i) a central portion through which the axis extends, the central portion disposed between the central portion of the spreader and the tubular wall of the base, (ii) an outer portion further away from the axis than the central portion, the outer portion disposed between the lateral wall of the base and the outer portion of the spreader, the outer portion terminating in an edge, with the outer wall of the base surrounding the edge of the outer portion of the perforated sheet, and (iii) a plurality of apertures through the perforated sheet.

15. The burner assembly of claim 14, wherein the central portion of the perforated sheet is separated from the tubular wall of the base; and the outer portion of the spreader is separated from the outer portion of the perforated sheet.

16. The burner assembly of claim 14, wherein a mixture of air and gaseous fuel flows into the inlet of the passageway of the base, through the passageway, out of the outlet of the passageway, through the plurality of apertures of the perforated sheet, and through the plurality of apertures of the spreader.

17. The burner assembly of claim 16, wherein a velocity of the mixture of air and gaseous fuel before the mixture of air and gaseous fuel flows through the plurality of apertures of the perforated sheet is greater than a velocity of the mixture of air and gaseous fuel after the mixture of air and gaseous fuel flows through the plurality of apertures of the perforated sheet.

18. The burner assembly of claim 14, wherein the apertures of the plurality of apertures through the perforated sheet each have a diameter of 1.9 mm to 2.1 mm.

19. The burner assembly of claim 18, the perforated sheet has a thickness that is 0.8 mm to 1.0 mm.

20. A burner assembly comprising:

an outlet of a passageway;

a spreader comprising a plurality of apertures; and a perforated sheet disposed between the outlet of the passageway and the spreader, the perforated sheet comprising a plurality of apertures, wherein the perforated sheet is disposed over the outlet of the passageway;

wherein, the burner assembly is configured to direct a mixture of air and gaseous fuel exiting the outlet of the passageway through the plurality of apertures of the perforated sheet and then through the plurality of apertures of the spreader.

21. The burner assembly of claim 20, wherein the perforated sheet further comprises an edge that fits within an area, and the plurality of apertures comprise 40 percent to 60 percent of the area within which the edge fits.

* * * * *